US010253492B2

(12) United States Patent
Uno et al.

(10) Patent No.: US 10,253,492 B2
(45) Date of Patent: Apr. 9, 2019

(54) COLUMN AND BEAM CONNECTION STRUCTURE AND METHOD

(71) Applicants: NIPPON STEEL & SUMIKIN METAL PRODUCTS CO., LTD., Tokyo (JP); HINODE, LTD., Fukuoka (JP)

(72) Inventors: Nobuyoshi Uno, Tokyo (JP); Kazuo Inoue, Osaka (JP); Hiroyuki Shinmura, Fukuoka (JP); Yugo Sato, Tokyo (JP); Tadayoshi Okada, Tokyo (JP)

(73) Assignee: NIPPON STEEL & SUMIKIN METAL PRODUCTS CO., LTD., Tokyo (JP)

( * ) Notice: Subject to any disclaimer, the term of this patent is extended or adjusted under 35 U.S.C. 154(b) by 0 days.

(21) Appl. No.: 15/750,000

(22) PCT Filed: Aug. 4, 2016

(86) PCT No.: PCT/JP2016/003614

§ 371 (c)(1),
(2) Date: Feb. 2, 2018

(87) PCT Pub. No.: WO2017/026113

PCT Pub. Date: Feb. 16, 2017

(65) Prior Publication Data

US 2018/0223521 A1 Aug. 9, 2018

(30) Foreign Application Priority Data

Aug. 7, 2015 (JP) ..... 2015-157554

(51) Int. Cl.

| | |
|---|---|
| ***E04B 1/24*** | (2006.01) |
| ***E04B 1/21*** | (2006.01) |
| ***E04B 1/58*** | (2006.01) |

(52) U.S. Cl.
CPC ..... *E04B 1/24* (2013.01); *E04B 1/215* (2013.01); *E04B 1/2403* (2013.01);
(Continued)

(58) Field of Classification Search
CPC ... E04B 1/24; E04B 1/215; E04B 1/58; E04B 1/5812; E04B 2001/2415;
(Continued)

(56) References Cited

U.S. PATENT DOCUMENTS 2,008,087 A * 7/1935 Stromberg ..... E04B 1/2403 403/189
3,938,297 A * 2/1976 Sato ..... E04B 1/2403 403/188

(Continued)

FOREIGN PATENT DOCUMENTS

| | | | |
|---|---|---|---|
| JP | 07324380 A | | 12/1995 |
| JP | 2000110236 A | * | 4/2000 |
| JP | 2000110236 A | | 4/2000 |
| JP | 2001262699 A | | 9/2001 |
| JP | 2010529331 A | | 8/2010 |

OTHER PUBLICATIONS

International Search Report (ISR) dated Sep. 20, 2016 issued in International Application No. PCT/JP2016/003614.

(Continued)

*Primary Examiner* — Adriana Figueroa
*Assistant Examiner* — Jessie T Fonseca
(74) *Attorney, Agent, or Firm* — Holtz, Holtz & Volek PC

(57) ABSTRACT

A column and beam connection structure for connecting a steel H-beam to a column uses an external diaphragm. The external diaphragm includes a plurality of divided diaphragm segments such that each diaphragm segment has a column plate abutting on the column. A diaphragm segment which is arranged along the steel H-beam among the plurality of divided diaphragm segments has a beam plate installed in a flange of the steel H-beam. The beam plate has an end portion in which the column plate is provided. A (Continued)

joining surface between the diaphragm segments is placed in a vicinity of a corner portion of the column so that only the column plate of one of the diaphragm segments abuts on each column surface of the column. A joining member fastens to fix between the diaphragm segments such that contact pressure is applied from the column plates to the surface of the column.

20 Claims, 27 Drawing Sheets

(52) U.S. Cl.
CPC .... *E04B 1/5812* (2013.01); *E04B 2001/2406* (2013.01); *E04B 2001/2415* (2013.01); *E04B 2001/2418* (2013.01); *E04B 2001/2448* (2013.01); *E04B 2001/2454* (2013.01); *E04B 2001/2478* (2013.01)

(58) Field of Classification Search
CPC ..... E04B 2001/2418; E04B 2001/2466; E04B 2001/2457; E04B 2001/2454; E04B 2001/2448; E04B 1/5831; Y10T 403/341; E04C 2003/0452; E04C 3/32; E04C 3/04; E04C 2003/0404; E04C 2003/0408; E04C 2003/0413; E04C 2003/0417
See application file for complete search history.

(56) References Cited

U.S. PATENT DOCUMENTS

| | | | | |
|---|---|---|---|---|
| 4,014,089 | A * | 3/1977 | Sato | E04B 1/2403 228/138 |
| 6,219,989 | B1 * | 4/2001 | Tumura | E04B 1/2403 52/274 |
| 9,951,510 | B2 * | 4/2018 | Lee | E04B 1/2403 |
| 2003/0041549 | A1 * | 3/2003 | Simmons | E04B 1/2403 52/655.1 |
| 2003/0208985 | A1 * | 11/2003 | Allen | E04B 1/2403 52/653.1 |
| 2004/0050013 | A1 * | 3/2004 | Okada | E04B 1/2403 52/848 |
| 2005/0055969 | A1 * | 3/2005 | Simmons | E04B 1/24 52/831 |
| 2008/0295443 | A1 | 12/2008 | Simmons | |
| 2012/0233945 | A1 * | 9/2012 | Rubel | E04B 1/24 52/236.3 |
| 2016/0076269 | A1 * | 3/2016 | Foldenauer | E04H 12/16 52/649.1 |
| 2016/0090729 | A1 * | 3/2016 | Takahashi | E04B 1/2403 52/698 |

OTHER PUBLICATIONS

Written Opinion dated Sep. 20, 2016 issued in International Application No. PCT/JP2016/003614.

* cited by examiner

COLUMN AND BEAM CONNECTION STRUCTURE AND METHOD

FIELD OF THE INVENTION

The present invention relates to a column and beam connection structure and method for connecting a column to a steel H-beam using an external diaphragm.

BACKGROUND OF THE INVENTION

In the prior art, a diaphragm construction method is applied to steel pipe columns here and there of a building structure for reinforcement and deformation prevention purposes, in many cases. In a through diaphragm construction method as one of such diaphragm construction methods, the steel pipe column is cut to match upper and lower flanges of the steel H-beam, and a diaphragm is inserted and welded to the steel pipe column, so that they are assembled. The steel H-beam is installed by cutting out a portion for connecting to the steel pipe column as a beam bracket in advance, welding the upper and lower flanges to the through diaphragm, and welding its web to a skin plate of the steel pipe column. The beam bracket installed in the diaphragm and the steel H-beam are joined to each other using a high-strength bolt friction connection.

In this through diaphragm construction method, a process of welding the diaphragm to the steel pipe column is added to the process of cutting the steel pipe column. In particular, this welding process necessitates perfect penetration welding around the entire circumference of the steel pipe. For this reason, an inspection of the welded portion is necessary in addition to the cutting process and the welding process. This disadvantageously increases a work burden necessary for the manufacturing. Furthermore, a well-skilled welding engineer is necessary in order to secure quality in the welded portion. Moreover, a correction work is necessary when the welded portion fails to pass a nondestructive inspection. This significantly increases the construction cost and the construction period disadvantageously. In addition, since a welding or cutting process is necessary, various types of equipment are also applied many times. This also increases energy consumption in the construction and adversely affects the environment.

As one of the diaphragm construction methods of the prior art, a HIBLADE process (registered trademark) has been employed in practical use. In this HIBLADE process (registered trademark), two pairs of cast steel integrated type external diaphragms (HIBLADEs) for upper and lower flanges are inserted into the steel pipe column. In addition, the upper and lower flanges of the steel H-beam are fixed to each external diaphragm by welding. The steel H-beam is cut out for a beam bracket for connecting to the steel pipe column. The upper and lower flanges of the beam bracket are welded to the HIBLADE, and a web of the beam bracket is welded to a rib plate installed in the column skin plate. The beam bracket and the steel H-beam are joined to each other with high-strength bolt friction connection. In such a HIBLADE, various techniques such as a shape having an excellent stress transfer property have been discussed.

However, in this HIBLADE process, a work for inserting the HIBLADE to the steel pipe column necessitates many processes and is also difficult in many cases. For this reason, in some cases, a special tool for inserting the HIBLADE to the steel pipe column is necessary. In addition, in this HIBLADE process, it is necessary to weld the HIBLADE to the upper and lower flanges of the steel H-beam. This increases the manufacturing labor and the manufacturing cost and delays the construction period disadvantageously as described above.

As one of the column and beam connection methods of the prior art, a high-strength bolt tension connection method is also employed in practical use. In this method, the steel pipe column and the steel H-beam are connected on the basis of high-strength bolt tension connection using a split tee or an end plate welded to a short section of the steel H-beam. Note that, when the split tee is employed, the flange of the split tee and the skin plate of the steel pipe column are joined on the basis of high-strength bolt tension connection, and the web of the split tee and the flange of the steel H-beam are joined on the basis of high-strength bolt friction connection. The web of the steel H-beam is joined to the rib plate installed in the steel pipe column on the basis of high-strength bolt friction connection as necessary.

However, in the high-strength bolt connection between the split tee or end plate and the steel pipe column, the steel pipe column has a closed cross section. Therefore, insertion and fastening of the high-strength bolts necessitate a lot of labor. Although a one-sided high-strength bolt or the like that can be inserted from one side is employed in practical use, this bolt is too expensive and has a limited strength. In addition, since bolt holes are to be fabricated in the steel pipe column, a special control device is necessary in order to secure positioning or accuracy of the bolt holes disadvantageously.

A technique of configuring the external diaphragm using a plurality of diaphragm segments has been discussed (for example, see Patent Document 1). However, in this technique discussed in Patent Document 1, the diaphragm segment is also welded to the steel pipe column. This increases the manufacturing labor and the manufacturing cost and delays the construction period disadvantageously as described above.

Patent Document 2 discusses an example in which a column-beam joint metal fitting like the diaphragm segment is combined to configure the external diaphragm in a similar manner. In this technique discussed in Patent Document 2, bolts are used for installation without welding the column-beam joint metal fitting to the steel pipe column. In addition, a filler such as mortar resin is filled in the column-beam joint metal fitting, so that stress is transferred using a bonding force of the filler and a shear capacity of the bolt. In the technique discussed in Patent Document 2, a welding process is not necessary to installation to the steel pipe column. Therefore, it is possible to prevent an increase of the manufacturing labor or the like advantageously.

CITATION LIST

Patent Documents

Patent Document 1: JP 2001-262699 A
Patent Document 2: JP H07-324380 A

SUMMARY OF THE INVENTION

However, in the technique discussed in Patent Document 2 described above, a process of filling a filler such as mortar resin is included. Accordingly, the manufacturing labor increases. In addition, the material cost for the filler is also necessary disadvantageously.

In view of the aforementioned problems, it is therefore an object of the present invention to provide a column and beam connection structure and method for connecting a steel H-beam to a column using an external diaphragm, by which welding to the external diaphragm is not necessary, the manufacturing labor, the manufacturing cost, and the construction period can be reduced, and excellent stress transfer performance can be provided in the event of an earthquake.

The inventors made diligent efforts to address the aforementioned problems and studied a column and beam connection structure and method for connecting a steel H-beam to a column using an external diaphragm, including: installing beam plates of a plurality of diaphragm segments obtained by dividing the external diaphragm in a flange of a steel H-beam; allowing a column plate provided in an end portion of the beam plate to abut on the column; placing a joining surface between the diaphragm segments in the vicinity of a corner portion of the column to allow each column surface of the column to abut on only the column plate of one of the diaphragm segments; and fastening and fixing each of the diaphragm segments via a joining member such that a contact pressure is applied from the column plate to the column surface of the column.

According to a first aspect of the invention, there is provided a column and beam connection structure for connecting a steel H-beam to a column using an external diaphragm. The external diaphragm includes a plurality of divided diaphragm segments. The diaphragm segment has a column plate abutting on the column. The diaphragm segment arranged along the steel H-beam among the plurality of divided diaphragm segments has a beam plate installed in a flange of the steel H-beam, the beam plate having an end portion in which the column plate is provided. A joining surface between the diaphragm segments is placed in a vicinity of a corner portion of the column so that only the column plate of one of the diaphragm segments abuts on each column surface of the column. A joining member fastens to fix between the respective diaphragm segments such that a contact pressure is applied from the column plate to the column surface of the column.

According to a second aspect of the invention, in the column and beam connection structure described in the first aspect, between the diaphragm segments, tensile joining portions erected upward and/or downward from a surface of the beam plate are provided, the tensile joining portions abutting on each other.

According to a third aspect of the invention, in the column and beam connection structure described in the second aspect, a bolt as the joining member is inserted between the tensile joining portions abutting on each other between the neighboring diaphragm segments and having a tip to which a nut is screwed.

According to a fourth aspect of the invention, in the column and beam connection structure described in the third aspect, the tensile joining portion and the joining member are separated from the flange of the steel H-beam.

According to a fifth aspect of the invention, in the column and beam connection structure described in the third aspect, a stress transfer mechanism for transferring a shearing force to a side separated from the column rather than the joining member is provided between the tensile joining portions abutting on each other between the neighboring diaphragm segments.

According to a sixth aspect of the invention, in the column and beam connection structure described in any one of the first to fifth aspects, the diaphragm segments are fixed to the column via the column plate by fastening means excluding welding or gluing.

According to a seventh aspect of the invention, in the column and beam connection structure described in any one of the first to sixth aspects, the external diaphragm is configured such that a gap is formed between the joining surfaces of the diaphragm segments arranged around the column while the column plate abuts on the column, and the joining member fastening to fix the diaphragm segments for reducing the gap generates the contact pressure.

According to an eighth aspect of the invention, in the column and beam connection structure described in any one of the first to seventh aspects, the external diaphragm is provided in each of the upper and lower flanges of the steel H-beam.

According to a ninth aspect of the invention, in the column and beam connection structure described in any one of the first to eighth aspects, the beam plate reduces the contact pressure from the column plate provided in an end portion of the beam plate to the column surface of the column and transfers a tensile force from the column plate to the other diaphragm segment having the other facing column plate when the tensile force is transferred from the steel H-beam, and the other diaphragm segment applies a compressive force from the other column plate to the column on the basis of the transferred tensile force.

According to a tenth aspect of the invention, in the column and beam connection structure described in any one of the first to ninth aspects, a vertical width of the column plate is wider in a corner portion side of the column and is narrower in a center portion side of the column.

According to an eleventh aspect of the invention, in the column and beam connection structure described in the tenth aspect, a column surface in the vicinity of the corner portion of the column receives a stronger contact pressure from the column plate.

According to a twelfth aspect of the invention, there is provided a column and beam connection method for connecting a steel H-beam to a column using an external diaphragm, including: causing a plurality of diaphragm segments obtained by dividing the external diaphragm to abut on the column and the divided diaphragm segments arranged along the steel H-beam among the plurality of diaphragm segments to install a beam plate provided with a column plate in its end portion to a flange of the steel H-beam; placing a joining surface between the diaphragm segments in a vicinity of a corner portion of the column to cause each column surface of the column to abut on only the column plate of one of the diaphragm segments; and fastening a joining member to fix each of the diaphragm segments such that a contact pressure is applied from the column plate to the column surface of the column.

According to the present invention described above, the external diaphragm can be installed in the steel pipe column in a stable state using a mechanical installation means without welding, so that it is possible to prevent the external diaphragm from falling down due to gravity by virtue of a frictional force exerted between the steel pipe column and the external diaphragm. In addition, in the event of an earthquake, a vertical acting force makes it possible to prevent the external diaphragm from moving in a vertical direction as significantly as a problem occurs in force transfer. In particular, since the external diaphragm can be fixed to the steel pipe column without welding, it is possible to reduce a work labor in the manufacturing. Furthermore, it is possible to reduce cost of the labor necessary for maintaining the quality of the welded portion and cost of various devices such as an inspection device and shorten manufacturing period. For this reason, it is possible to perform construction with reduced energy consumption and employ an environmentally friendly connection method. Moreover, since a process of filling a filler such as mortar resin can be eliminated, it is possible to further reduce the manufacturing labor and cost.

According to the present invention, it is possible to eliminate a labor of cutting out the steel pipe column unlike the through diaphragm construction method of the prior art. In addition, according to the present invention, since a so-called web of the steel H-beam is not directly joined to the steel pipe column, a beam bracket may not be provided between the web and the steel pipe column unlike the prior art. In this case, a configuration of the beam bracket usually employed in the prior art becomes unnecessary, so that it is possible to remarkably reduce the construction cost by reducing the manufacturing labor and also reduce the construction period. Furthermore, since the beam bracket becomes unnecessary, it is not necessary to install the beam bracket in the steel pipe column in advance, and the steel pipe can be delivered as it is. Therefore, it is possible to efficiently perform the delivery. In addition, it is possible to secure stable quality of the connection structure. Since welding is not performed, necessity of considering design for improving impact resistance or the like is considerably reduced. Therefore, it is possible to improve freedom of design.

DESCRIPTION OF EMBODIMENTS

A connection structure between a steel pipe column and a beam according to the present invention will now be described in details with reference to the accompanying drawings.

Figure 1:
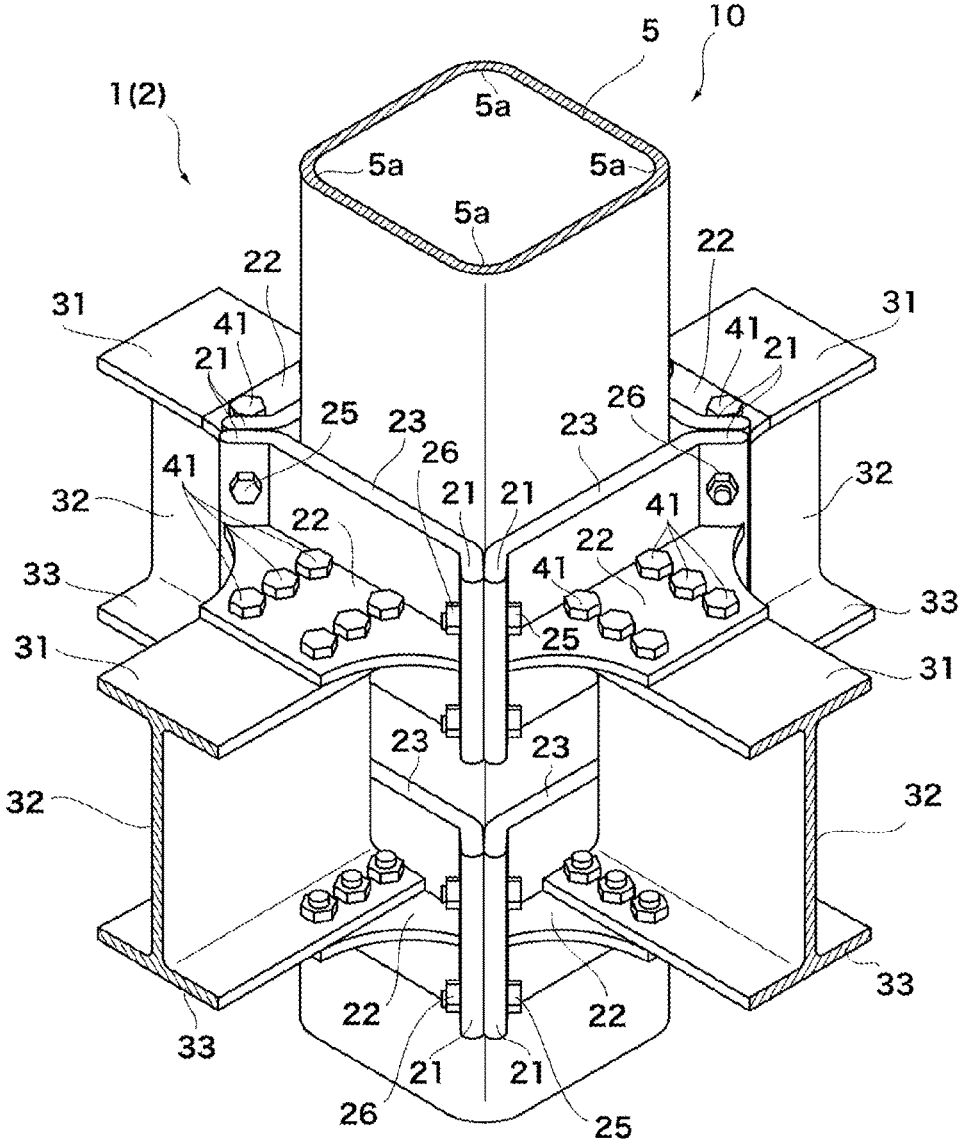
FIG. 1 is a perspective view illustrating a connection structure between a steel pipe column and a beam according to the present invention.
Figure 2:
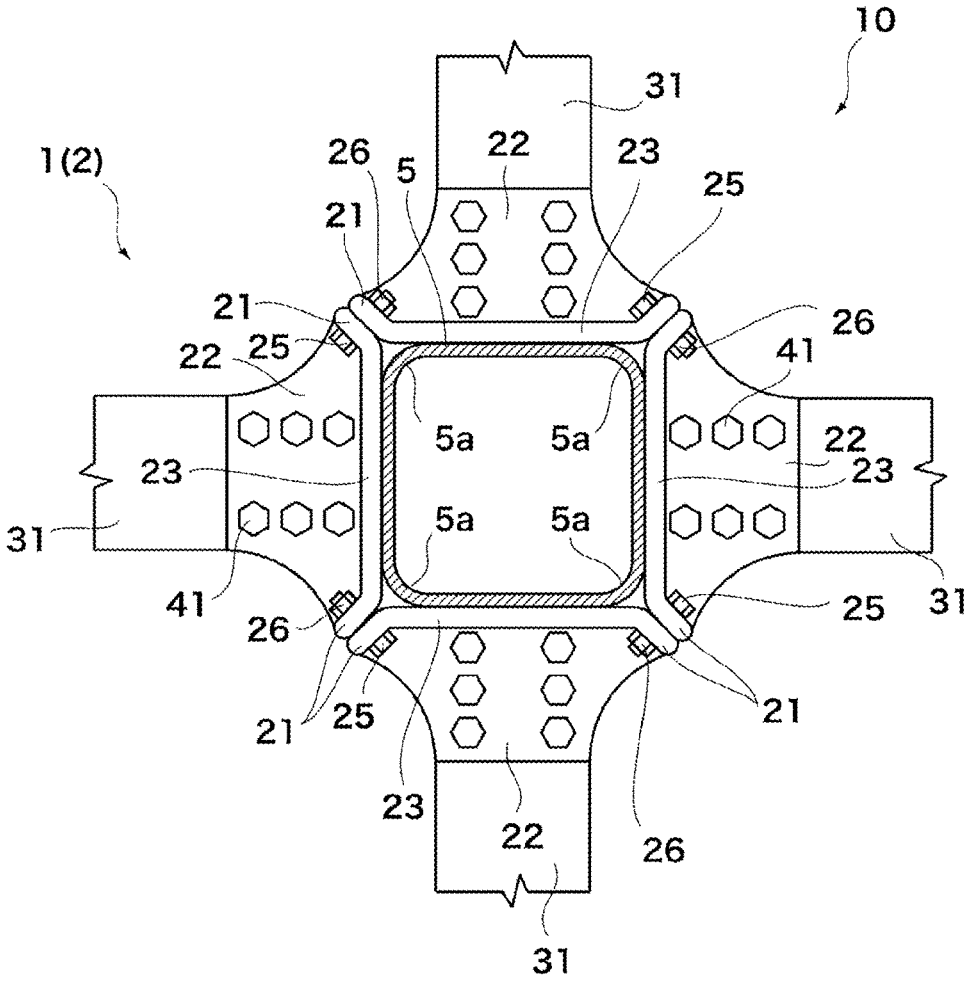
FIG. 2 is a cross-sectional plan view illustrating the connection structure between the steel pipe column and the beam according to the present invention.
Figure 3:
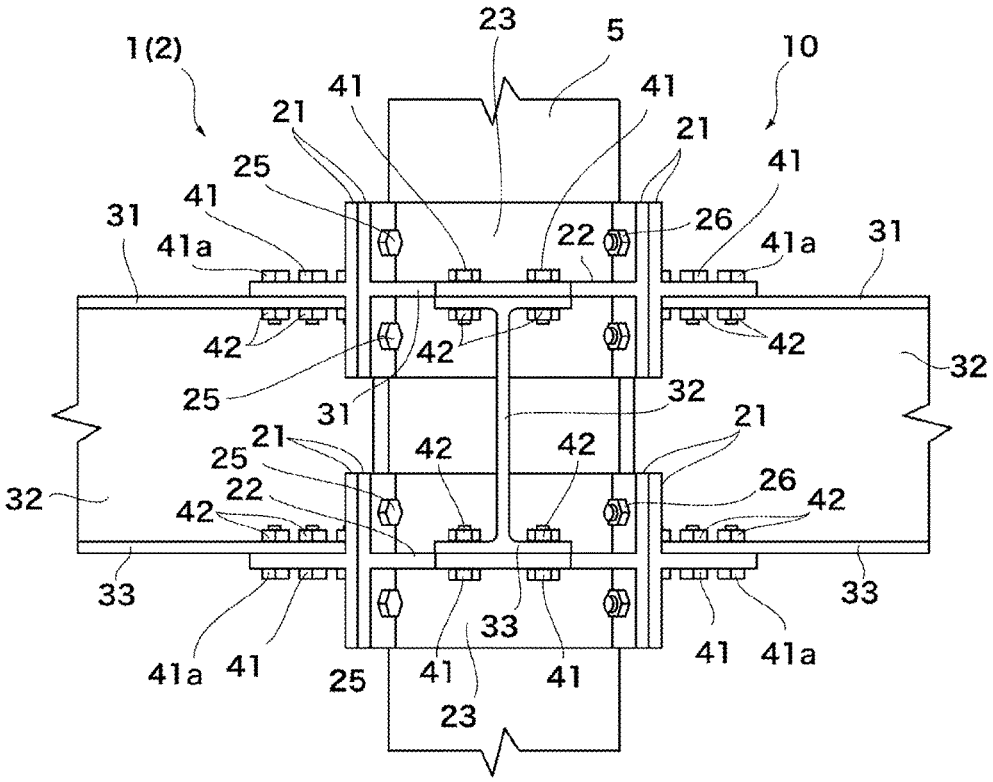
FIG. 3 is a side view illustrating the connection structure between the steel pipe column and the beam according to the present invention.

FIG. 1 is a perspective view illustrating the connection structure 10 between the steel pipe column and the beam according to the present invention, FIG. 2 is a cross-sectional plan view of FIG. 1, and FIG. 3 is a side view of FIG. 1.

In the connection structure 10 between the steel pipe column and the beam according to the present invention, a steel H-beam 3 is arranged perpendicularly to a column surface of the steel pipe column 5 using an external diaphragm 1. Alternatively, without limiting thereto, the steel H-beam 3 may be arranged obliquely to the column surface of the steel pipe column 5 in a vertical direction or a left-right direction.

The steel pipe column 5 is a steel pipe having a rectangular cross-sectional shape with a predetermined plate thickness as a columnar structure for use in a building structure. The steel pipe column 5 supports a self weight of the building structure and prevents a crash or collapse even in a strong shock caused by a major earthquake. Note that, in the following embodiment, it is assumed that the steel pipe column 5 has a rectangular cross-sectional shape such as a square cross-sectional shape or an oblong cross-sectional shape by way of example. The corner portion 5*a* of the steel pipe column 5 may have an arc shape or a substantially right-angled shape.

The steel H-beams 3 form a frame of the building structure along with the steel pipe columns 5 and are formed of an H-beam having an upper flange 31 provided in an upper end of a web 32 and a lower flange 33 provided in a lower end of the web 32. The steel H-beam 3 is installed perpendicularly to a column surface of the steel pipe column 5 using the external diaphragm 1. In the example of FIG. 1, it is assumed that just four steel H-beams are arranged in the steel pipe column 5 at an angle of 90°, but not limited thereto. Note that the steel H-beam 3 is broken down earlier than the steel pipe column 5 for plasticization even when a significant stress is applied in a major earthquake or the like as described below. Further, the steel H-beam 3 prevents a crash of a building structure by preventing or reducing plasticization of the steel pipe column 5.

As illustrated in FIG. 3, a pair of upper and lower external diaphragms 1 are provided by inserting the steel H-beams 3. The upper external diaphragm 1 is installed over the upper flange 31, and the lower external diaphragm 1 is installed under the lower flange 33. The external diaphragm 1 is formed by assembling a plurality of diaphragm segments 2. Specifically, as seen in a plan view, the external diaphragm 1 is formed by diaphragm segments 2 arranged to surround the steel pipe column 5. It is assumed that the external diaphragm 1 is formed of steel, stainless steel, cast steel, spheroidal graphite cast iron, or the like, but not limited thereto. Alternatively, the external diaphragm 1 may be formed of other metals than the steel such as aluminum alloy.

The diaphragm segment may be a factory welding assembly product whose welding quality can be strictly managed.

The diaphragm segments 2 function as a single external diaphragm 1 when they are assembled. According to this embodiment, the diaphragm segment 2 is shaped by equally dividing the external diaphragm 1 into four pieces, but not limited thereto. Alternatively, the diaphragm segment 2 may be shaped by dividing the external diaphragm 1 into any number of pieces as long as it is plural. The shape of the diaphragm segment 2 is not limited to the equally divided shape, but may have an unequally divided shape as long as a plurality of pieces are combined into a single external diaphragm 1.

Figure 4:
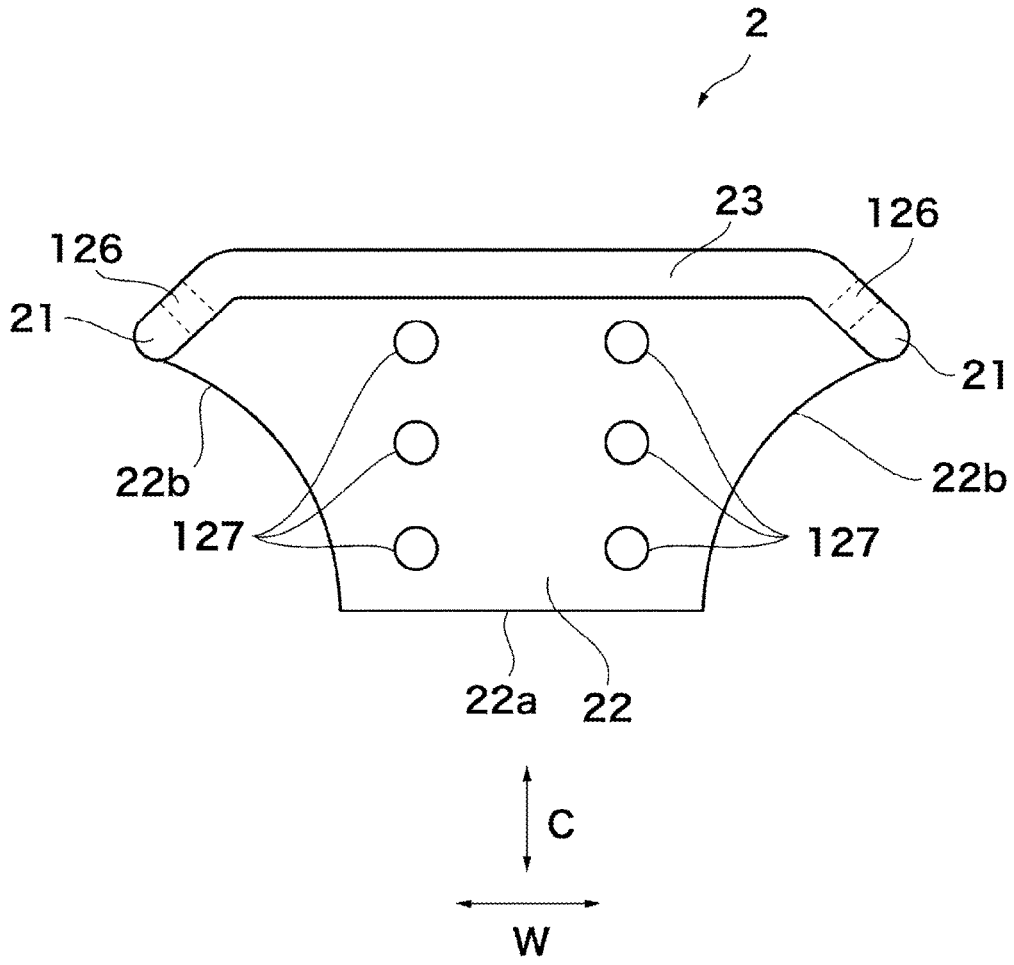
FIG. 4 is a plan view illustrating one of diaphragm segments.
Figure 5:
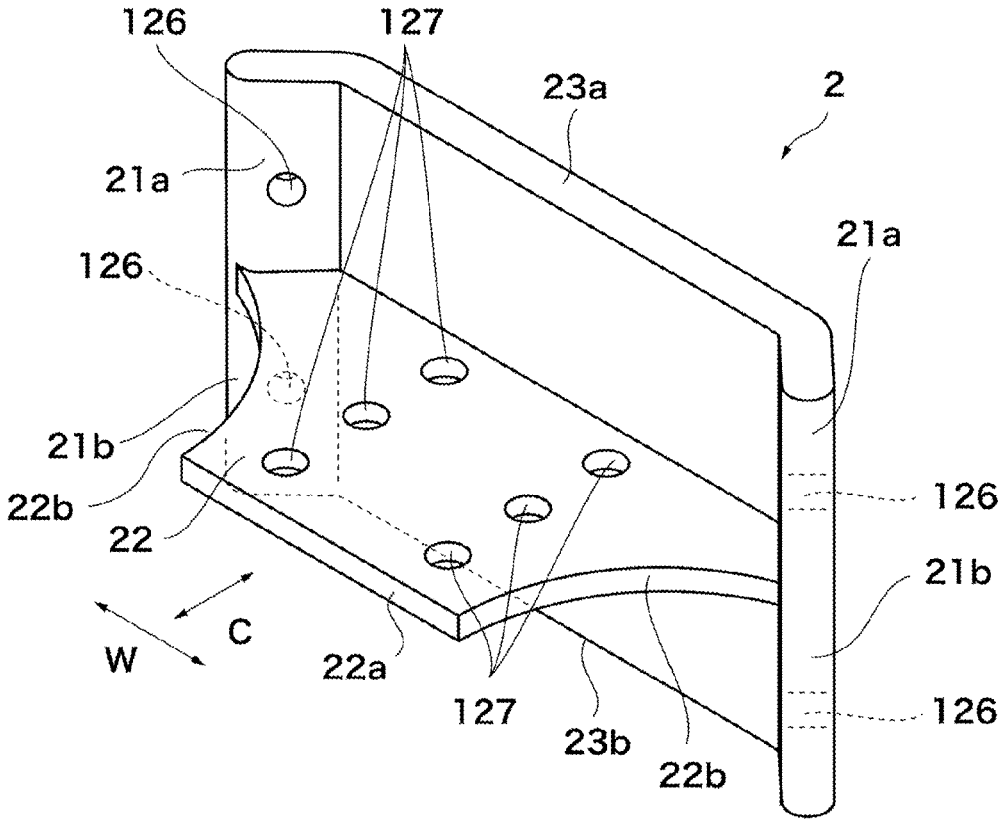
FIG. 5 is a perspective view illustrating one of diaphragm segments.

FIG. 4 is a plan view illustrating one of the diaphragm segments 2, and FIG. 5 is a perspective view illustrating the same. The diaphragm segment 2 has a beam plate 22 spliced to an upper flange 31 or lower flange 33 of the steel H-beam 3 and a column plate 23 abutting on the steel pipe column.

The beam plate 22 has bolt holes 127 bored in advance to install bolts to the upper flange 31 or lower flange 33 of the steel H-beam 3. The beam plate 22 is provided with a plurality of bolt holes 127 along a longitudinal direction C or a width direction, assuming that the longitudinal direction of the steel H-beam 3 is denoted by "C."

The beam plate 22 has a straight front end portion 22*a* and lateral end portions 22*b* widened from the front end portion 22*a* in an arc shape. The lateral end portion 22*b* may have a rib (not shown) formed to protrude upward and/or downward. A width of the direction W of the front end portion 22*a* of the beam plate 22 may be substantially equal to a width of the direction W of the upper flange 31 or lower flange 33 of the steel H-beam 3. In either case, a single beam plate 22 is in size capable of being joined to only a single upper flange 31 or lower flange 33 of the steel H-beam 3. In other words, the beam plates of two or more neighboring diaphragm segments 2 are not connected to the one upper flange 31 or lower flange 33. Note that the invention is not limited to a case where the lateral end portion 22*b* of the beam plate 22 is widened from the front end portion 22*a* in an arc shape, but the lateral end portion 22*b* may be widened in any shape.

The splice surface of the beam plate 22 to the flange 31 or 33 is subjected to a high-frictional-coefficient treatment as necessary. The high-frictional-coefficient treatment may include a metal spraying treatment, an inorganic zinc-rich coating treatment, or the like as appropriate. Alternatively, a thin metal sheet subjected to the high-frictional-coefficient treatment may be inserted between the beam plate 22 and the flange 31 or 33.

Such a beam plate 22 is installed in every steel H-beam 3 arranged at an angle of 90° as seen in a plan view.

The column plate 23 is provided in an end portion of the direction C of the beam plate 22. The width of the direction W of the column plate 23 is set to be larger than the width of the direction W of the front end portion 22*a* of the beam plate 22. In other words, the beam plate 22 is gradually widened from the front end portion 22*a* to the column plate 23. A plate surface of the column plate 23 extends perpendicularly to a plate surface of the beam plate 22. The width of the direction W of the column plate 23 is nearly equal to the width of each column surface of the steel pipe column 5 or wider than the width of each column surface of the steel pipe column 5. In addition, as illustrated in FIG. 5, the column plate 23 may have an upper column plate portion 23*a* extending upward from the end portion of the beam plate 22 and a lower column plate portion 23*b* extending downward from the end portion of the beam plate 22. The column plate 23 can be fixed by abutting on a surface of the steel pipe column 5. The column plate 23 may have only one of the upper column plate portion 23*a* and lower column plate portion 23*b*.

The column plate 23 may be subjected to an anti-slipping treatment on the surface abutting on the steel pipe column 5 as necessary. The anti-slipping treatment may include a blast treatment, a coating treatment, a metal spraying treatment, an embossing treatment using a knurling tool or cutting, or the like as appropriate.

Tensile joining portions 21 are provided in both ends of the column plate 23. When the diaphragm segment 2 is formed of a steel plate, the column plate 23 and the tensile joining portions 21 may be formed by bending a single steel plate or may be joined by welding separate steel plates or the like. The tensile joining portion 21 extends to a direction bent at an angle of approximately 45° from the extension direction (direction W) of the column plate 23 as seen in a plan view. The beam plate 22 gradually widened from the front end portion 22*a* is continuously connected to the tensile joining portion 21 from the lower side. The tensile joining portion 21 may have an upper tensile joining portion 21*a* extending upward from the beam plate 22 and a lower tensile joining portion 21*b* extending downward from the beam plate 22. The tensile joining portions 21 are provided with the penetrating bolt holes 126. The bolt holes 126 may be provided in each of the upper tensile joining portion 21*a* and lower tensile joining portion 21*b* when the tensile joining portion 21 includes the upper tensile joining portion 21*a* and lower tensile joining portion 21*b*.

Alternatively, the tensile joining portion 21 may have a plate thickness different from that of the column plate 23 or may have different extension lengths in upper and lower directions.

Note that the surface of the column plate 23 is substantially perpendicular to the surface of the beam plate 22. In this case, when a corner portion of a joining portion between the column plate 23 and the beam plate 22 is substantially perpendicular, a stress is concentrated on this corner portion. In order to avoid concentration of the stress on the corner portion, the corner portion may be rounded at an angle R.

Figure 6:
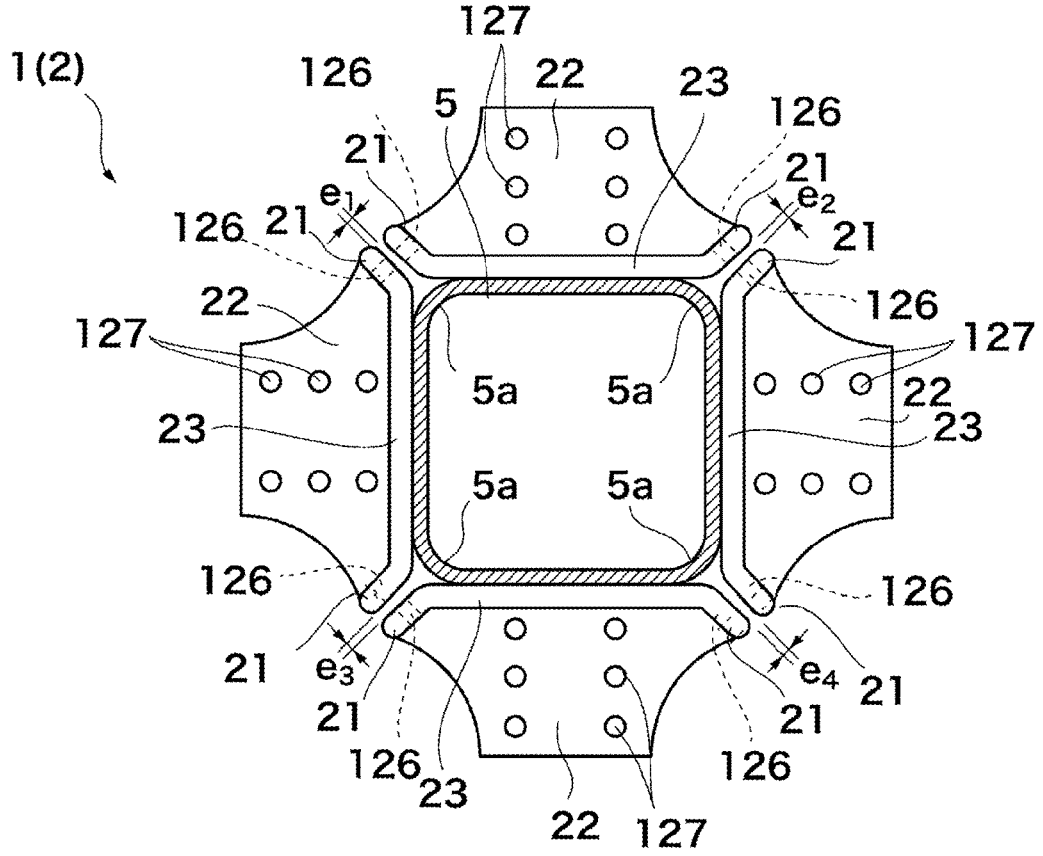
FIG. 6 is a diagram illustrating an exemplary external diaphragm obtained by combining the diaphragm segments.

Then, when the diaphragm segments 2 configured as described above are assembled to form a single external diaphragm 1, for example, as illustrated in FIG. 6, four diaphragm segments 2 are arranged around the steel pipe column 5. In this case, the column plates 23 of the diaphragm segments 2 abut on the column surfaces of the steel pipe column 5. As described above, the width of the direction W of the column plate 23 is substantially equal to the width of each column surface of the steel pipe column 5. Therefore, only the column plate 23 of a single diaphragm segment 2 accurately abuts on each column surface of the steel pipe column 5. As a result, the column plates 23 of two or more diaphragm segments 2 do not abut on a single column surface of the steel pipe column 5.

The tensile joining portions 21 as a joining surface between the neighboring diaphragm segments 2 are placed in the vicinity of the corner portion 5*a* of the steel pipe column 5.

The tensile joining portions 21 are formed in both ends of the direction W of the column plate 23 as described above. Since the width of the direction W of the column plate 23 is substantially equal to the width of each column surface of the steel pipe column 5, the tensile joining portions 21 in both ends of the direction W of the column plate 23 are placed in the vicinity of the corner portion 5*a* of the steel pipe column 5.

Since each tensile joining portion 21 extends in the direction bent at an angle of 45° from the extension direction (direction W) of the column plate 23 as seen in a plan view, the tensile joining portions 21 of the neighboring diaphragm segments 2 are substantially in parallel with each other.

In this abutting process, a gap is formed between the tensile joining portions 21 of the neighboring diaphragm segments 2. According to the present invention, the gap e ($e_1$, $e_2$, $e_3$, and $e_4$) is designed to satisfy at least a condition "e≥0."

Then, the external diaphragm 1 is installed. The neighboring diaphragm segments 2 are joined by inserting bolts 25 into the bolt holes 126 formed in the tensile joining portions 21 placed in parallel with each other and fastening thread portions of the bolts 25 to the nuts 26. By fastening the bolts 25 with the nuts 26, the neighboring diaphragm segments 2 gradually approach each other by interposing the tensile joining portions 21. In addition, when the bolts 25 and 26 is completely fastened, the tensile joining portions 21 of the neighboring diaphragm segments 2 make contact with each other or approach each other, so that the above described gap e is reduced. In this case, if the gap e is reduced, the gap e is reduced to zero naturally. Alternatively, the diaphragm segments 2 may not make contact with each other by setting the gap to "e>0."

Then, the external diaphragm 1 and the steel H-beam 3 are installed. The bolts 41 are inserted into the bolt holes 127 bored on the beam plates 22 of the diaphragm segments 2. In this case, bolt holes (not shown) are also formed in the upper flange 31 or lower flange 33 to be spliced to the beam plate 22 in advance, and the bolts 41 are inserted by matching these bolt holes with the bolt holes 127. In addition, the nuts 42 are screwed and fastened to the thread portions of the bolts 41 protruding from the flanges 31 and 33. As a result, the beam plates 22 and the flanges 31 and 33 of the steel H-beam 3 are strongly installed and fixed to each other. Alternatively, instead of using the bolt joining between the diaphragm segments 2 and the steel H-beams 3, they may be fixed by facing and welding the end portion of the beam plate 22 and the end portions of the flanges 31 and 33 of the steel H-beam 3 with each other. Furthermore, the beam plate 22 and the flanges 31 and 33 may be overlapped with and fixed to each other by fillet welding or may be connected using any other joining means.

Figure 7:
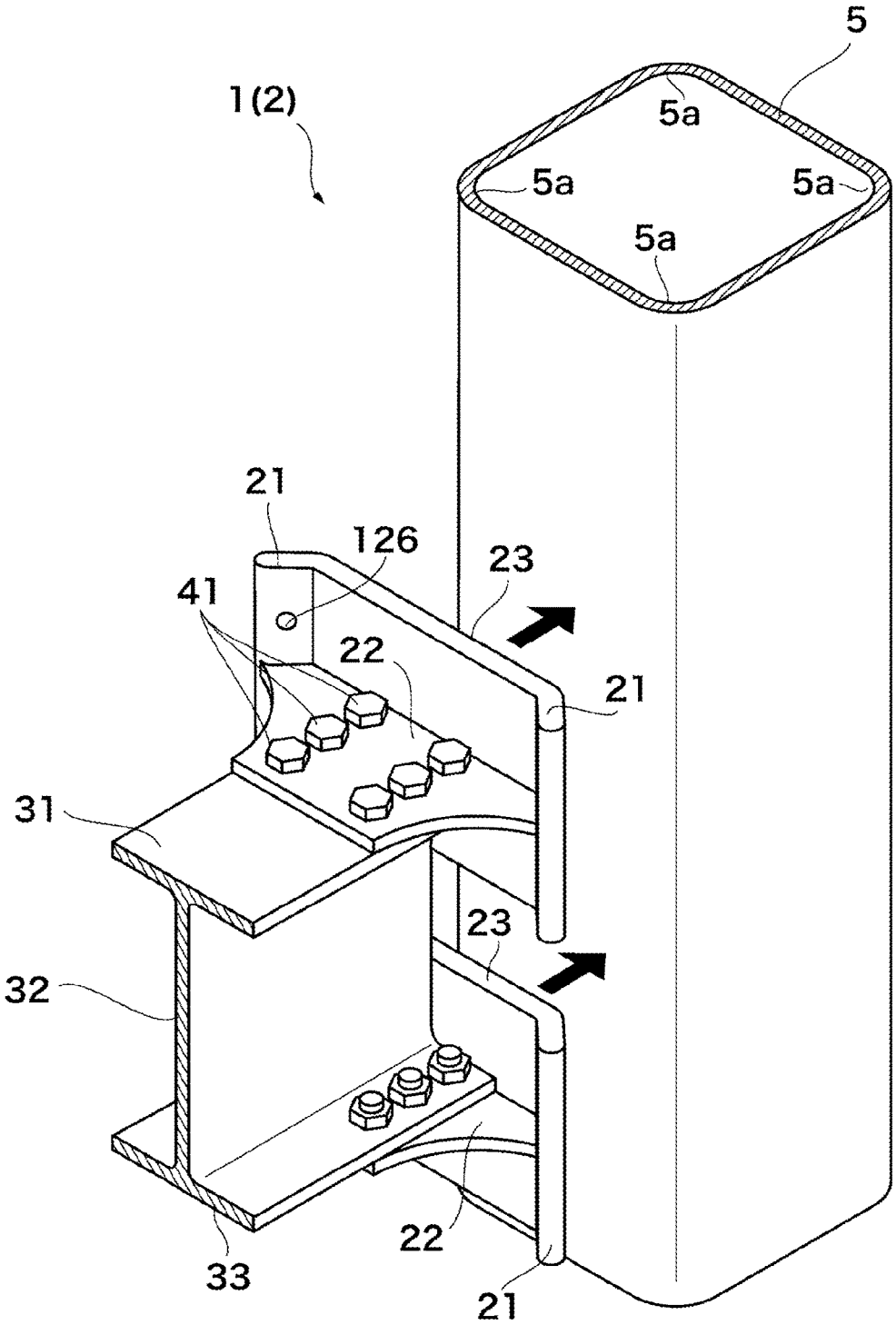
FIG. 7 is a diagram for describing an exemplary method of connecting the steel pipe column and the beam according to the present invention.

A single beam plate 22 is in size capable of being joined to only a single upper flange 31 or lower flange 33 as described above. That is, a single beam plate 22 and a single upper flange 31 or lower flange 33 are mated with each other one by one. Therefore, the beam plate 22 may be joined to the upper flange 31 or lower flange 33 of the steel H-beam 3 using bolts in advance as illustrated in FIG. 7. That is, the diaphragm segments 2 may be installed and integrated into the steel H-beam 3 in advance and may be then brought to abut on the steel pipe column 5 by moving in the arrow direction of the drawing. As a result, application of the connection structure 10 is facilitated, and it is possible to expedite the construction work. In addition, according to the present invention, the diaphragm segments 2 are installed and integrated into the steel H-beam 3 in a factory in advance, and this assembly may be delivered to a construction site in this state. Therefore, it is possible to optimize a field construction work.

In this manner, according to the present invention, joining of the diaphragm segments 2 is wholly performed only on the basis of a so-called mechanical joining member such as bolts without any welding process. Alternatively, instead of the joining using the bolts 25 and 41, any other joining member may also be employed.

Joining of the diaphragm segments 2 and joining between the beam plate 22 and the upper flange 31 and lower flange 33 may be performed in any sequence.

In this manner, since the joining is performed such that the gap e between the diaphragm segments 2 is reduced and becomes finally zero, a compressive force is applied from the external diaphragm 1 consisting of the diaphragm segments 2 toward the steel pipe column 5. This compressive force is transferred from the column plate 23 of the diaphragm segment 2 to the column surface of the steel pipe column 5. As a result, a contact pressure is applied between the column plate 23 and the steel pipe column 5. Therefore, it is possible to exert a strong frictional force to the contact surface. Although the external diaphragm 1 receives a descending force due to its gravity, it is possible to exert a frictional force against gravity between the contact surfaces because a strong contact pressure is applied to the contact surfaces between the column plate 23 and the steel pipe column 5. As a result, the external diaphragm 1 can be installed in a stable state even without welding the steel pipe column 5. Therefore, it is possible to prevent the external diaphragm 1 from descending due to gravity or the like. In particular, since the external diaphragm 1 can be fixed to the steel pipe column 5 without welding, it is possible to reduce a work labor in the manufacturing. In addition, it is possible to reduce the labor cost necessary for maintaining the quality of the welded portion and the cost of various devices such as an inspection device and shorten the manufacturing period. For this reason, it is possible to perform construction with reduced energy consumption and employ an environmentally friendly connection method.

According to the present embodiment, it is possible to eliminate a labor of cutting out the steel pipe column unlike the through diaphragm construction method of the prior art. In addition, the web 32 of the so-called steel H-beam 3 is not directly joined to the steel pipe column 5, and no beam bracket as in the prior art is provided between the web 32 and the steel pipe column 5. In this case, since the beam bracket of the prior art is unnecessary, it is possible to remarkably reduce the construction cost based on the reduction of the manufacturing labor and shorten the construction period. Furthermore, since the beam bracket becomes unnecessary, it is not necessary to install the beam bracket to the steel pipe column 5 in advance. Since the steel pipe can be delivered as it is, delivery efficiency can be improved. Moreover, since the welding is eliminated as much as possible, it is possible to easily secure the stable quality of the connection structure 10.

According to the present embodiment, naturally, the beam bracket may also be provided between the web 32 and the steel pipe column 5 as in the prior art although the aforementioned effect is reduced.

Figure 8:
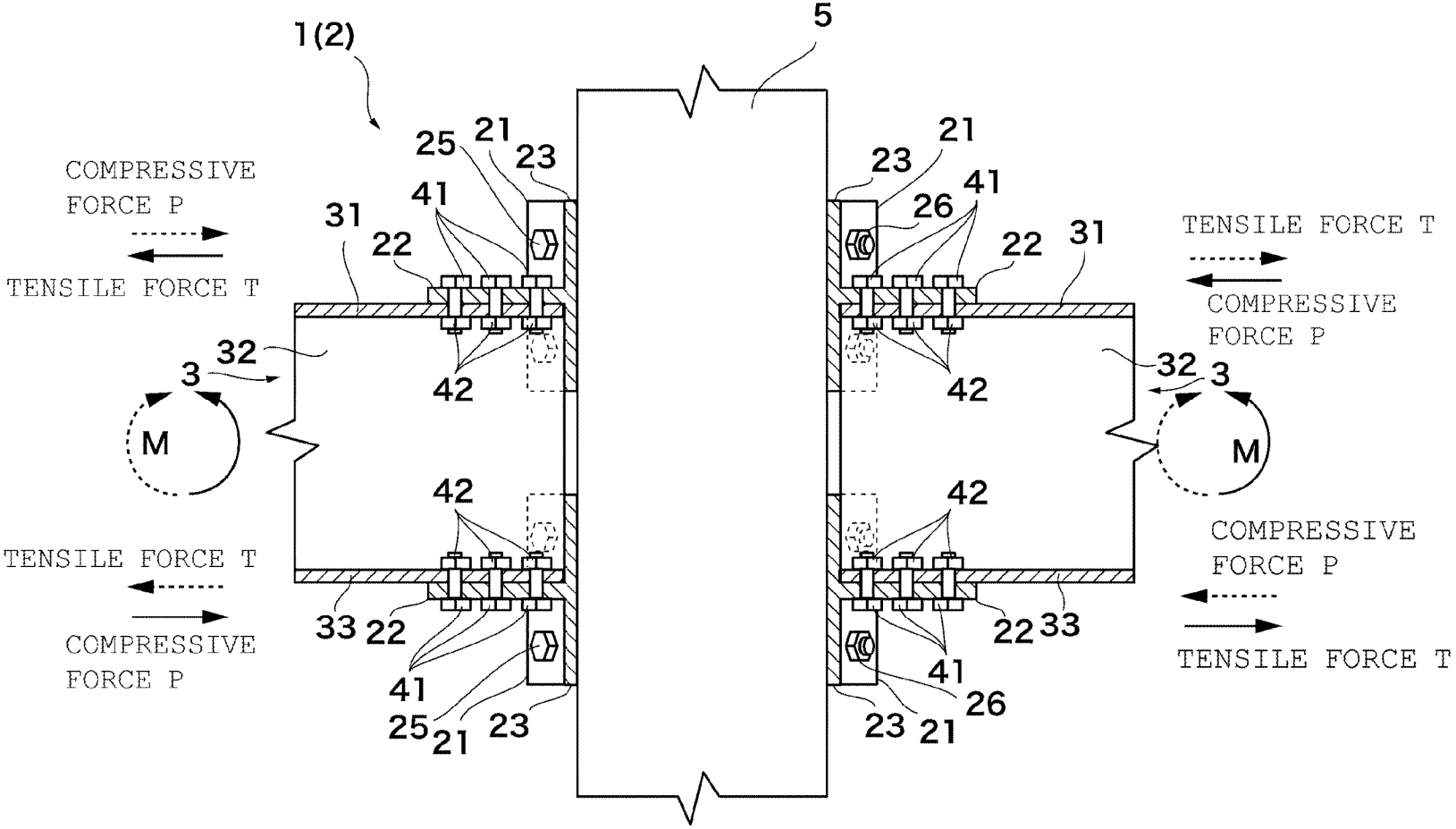
FIG. 8 is a diagram illustrating a bending moment M applied to a steel H-beam when a seismic force is applied to the connection structure according to the present invention.

When a seismic force is applied to the connection structure 10 according to the present invention configured as described above, a bending moment M is applied to the steel H-beam 3 as illustrated in FIG. 8. When such a bending moment M is applied to the steel H-beam 3, it is converted into an axial force of the flanges 31 and 33, and this axial force propagates through the flanges 31 and 33. The axial force propagating through the flanges 31 and 33 becomes a tensile force T in the connection structure 10 as illustrated in FIG. 9 depending on the direction of the bending moment and a compressive force P as illustrated in FIG. 10.

When a tensile force is applied to the upper flange 31 under the bending moment M acting as described above, a compressive force is applied to the lower flange 33. In addition, when a compressive force is applied to the upper flange 31, a tensile force is applied to the lower flange 33.

Here, when a tensile force T based on the axial force is applied to the connection structure 10, first, the tensile force T is transferred through the flange 31 or 33 of the steel H-beam 3. The tensile force T from the flange 31 or 33 is transferred to the beam plate 22 of the diaphragm segment 2. As a result of pulling the beam plate 22 in a vector direction of the tensile force T in FIG. 9, the column plate 23 connected thereto is also pulled in this direction. As a result, it is possible to weaken the contact pressure F originally applied to the steel pipe column 5 from the column plate 23. Note that, according to this embodiment, the steel pipe column 5 and the column plate 23 are merely in contact with each other, and are not directly connected to each other using other joining means or by welding. For this reason, the tensile force T is not directly applied to the steel pipe column 5 through the beam plate 22 and the column plate 23.

Figure 9:
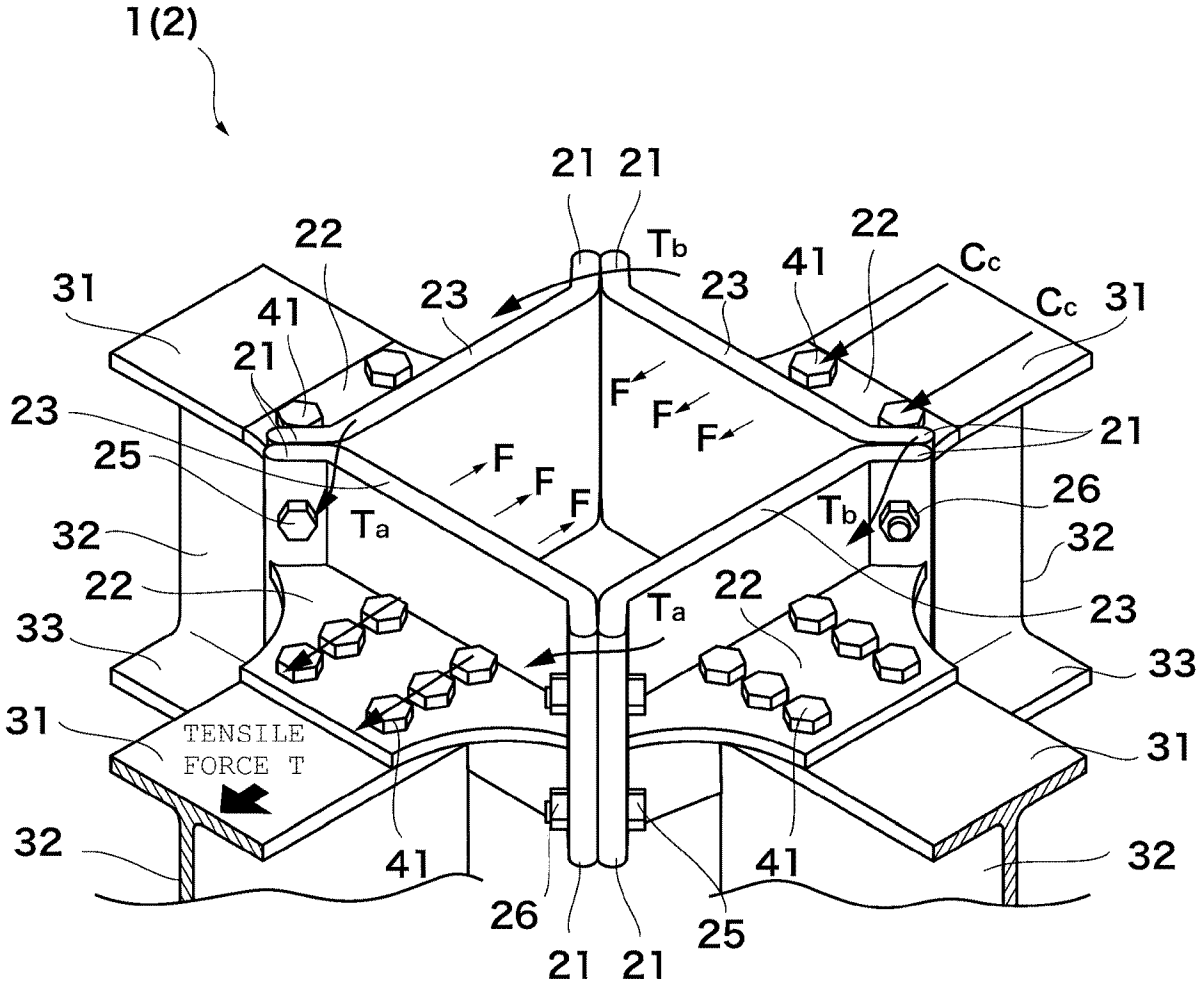
FIG. 9 is a diagram illustrating a transfer path of a tensile force transferred to a beam plate of the diaphragm segment.
Figure 10:
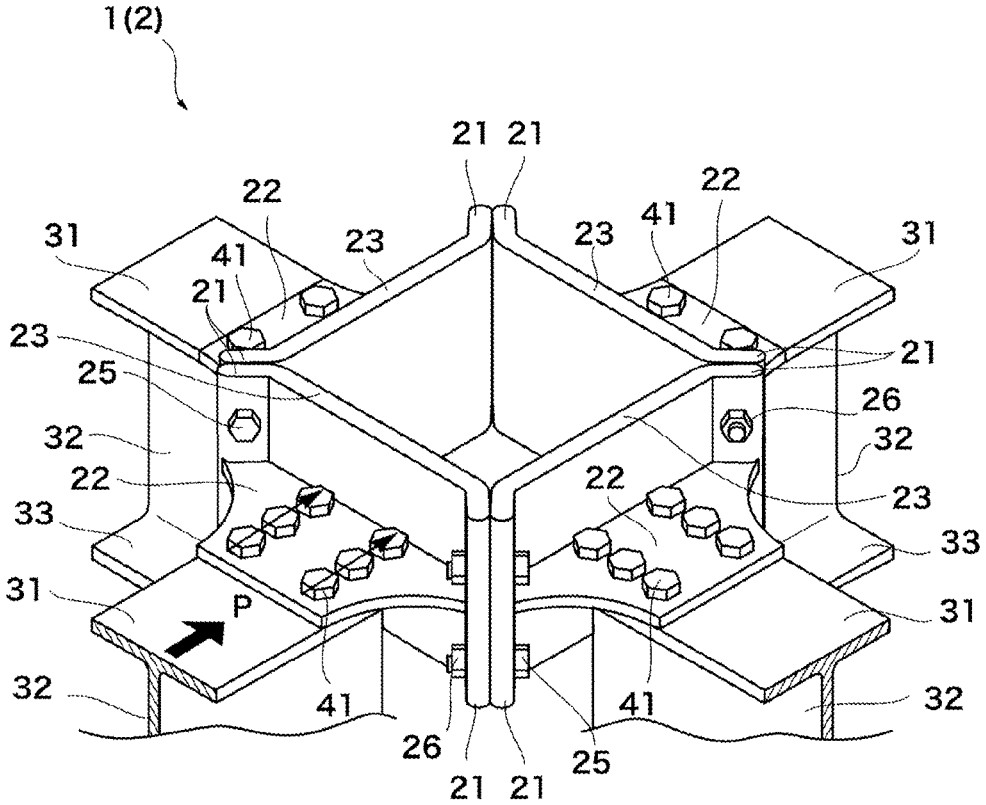
FIG. 10 is a diagram illustrating a transfer path of a compressive force transferred to the beam plate of the diaphragm segment.

The tensile force T transferred to the beam plate 22 of the diaphragm segment 2 is transferred along paths of the forces $T_a$ and $T_b$ in FIG. 9. That is, the forces $T_a$ and $T_b$ are transferred by bypassing the steel pipe column 5 through the column plate 23 and the tensile joining portion 21. In addition, the forces $T_a$ and $T_b$ are transferred to the diaphragm segment 2 having another column plate 23 facing the column plate 23 provided in the beam plate 22, to which the tensile force T is initially transferred, by interposing the steel pipe column 5.

In this case, the beam plate 22 is shaped such that it is gradually widened from the front end portion 22*a* to the column plate 23 and is rounded at an angle R. In particular, as seen in a plan view, the width of the beam plate 22 installed around the steel pipe column 5 increases, so that the transfer path of the forces $T_a$ and $T_b$ can be more widened, and a stress can be smoothly transferred. As a result, since the transfer path of the forces $T_a$ and $T_b$ is not locally narrowed or bent abruptly, it is possible to suppress stress concentration. Consequently, it is possible to secure structural stability of the connection structure 10 itself.

In the column plate 23 facing column plate 23 provided in the beam plate 22, to which the tensile force T is initially transferred, by interposing the steel pipe column 5, a force $C_c$ of FIG. 9 is accurately applied to the steel pipe column 5 in response to the stress transferred in this manner. This force $C_c$ has the same direction as that of the tensile force T transferred from the beam plate 22 and serves as a compressive force $C_c$ applied from the receiving column plate 23 to the steel pipe column 5. That is, the tensile force T is converted into the compressive force $C_c$ applied from the facing column plate 23 to the steel pipe column 5. Although a contact pressure based on fastening of the joining member described above is originally applied from the facing column plate 23 to the steel pipe column 5, the compressive force $C_c$ is further added to this contact pressure.

In this manner, according to the present embodiment, by simply allowing the steel pipe column 5 and the column plate 23 to abut on each other, the tensile force T is prevented from directly applied to the steel pipe column 5 through the beam plate 22 and the column plate 23. Meanwhile, the corresponding tensile force T is propagated through the other paths and can be converted into the compressive force $C_c$ of the facing diaphragm segment 2, finally.

When the compressive force P based on the axial force is applied to the connection structure 10, first, this compressive force P is transferred through the flange 31 or 33 of the steel H-beam 3 as illustrated in FIG. 10. The compressive force P from the flange 31 or 33 is transferred to the beam plate 22 of the diaphragm segment 2. The beam plate 22 is pressed in a vector direction of the compressive force P in the drawing, so that the column plate 23 connected thereto is also pressed in this direction. Although the contact pressure based on fastening of the joining member described above is originally applied from the column plate 23 to the steel pipe column 5, the compressive force P is further added to this contact pressure.

In this manner, in the connection structure 10 according to the present invention, the tensile force is not directly transferred to the steel pipe column 5, but can be transferred wholly as a compressive force even when any one of the tensile force T and the compressive force P is applied through the beam plate 22. For this reason, even when the steel H-beam 3 receives a bending moment M of any direction caused by a seismic force, the bending moment M can be transferred to the steel pipe column 5 as a compressive force.

According to this embodiment, since only the compressive force is applied to the steel pipe column 5, the steel pipe column 5 receiving the compressive force remains in a substantially elastic deformation range without a particularly significant out-of-plane deformation at the joining portion. As a result, it is possible to prevent plasticization caused by applying a tensile force to the steel pipe column 5. In addition, since plastic deformation of the steel pipe column 5 is prevented, and the steel H-beam 3 receiving the tensile force is first plasticized, it is possible to prevent a crash of the building structure. For this reason, it is not necessary to increase a plate thickness of the steel pipe column 5 to prevent plastic deformation of the steel pipe column 5. This facilitates reduction of the cost of the steel material.

According to this embodiment, as a result of applying the tensile force T to the column plate 23 as illustrated in FIG. 9, the contact pressure from the column plate 23 facing thereto by interposing the steel pipe column 5 can increase as much as the compressive force $C_c$ even when the contact pressure F originally applied from the column plate 23 to the steel pipe column 5 is reduced. As a result, since most of the contact pressure applied between the column plate 23 and the steel pipe column 5 in the entire external diaphragm 1 does not change, it is possible to desirably exert a frictional force therebetween. As a result, even when the contact pressure F to the steel pipe column 5 is reduced, it is possible to prevent the external diaphragm 1 from falling down due to gravity or the like.

According to this embodiment, the tensile joining portion 21 extends in a direction bent from the extending direction (W direction) of the column plate 23 at an angle of approximately 45° as seen in a plan view. For this reason, even when the end portions of the flanges 31 and 33 of the steel H-beam 3 approach the steel pipe column 5, the flanges 31 and 33 are separated from the tensile joining portion 21 and do not interfere with each other. Similarly, the joining members such as the bolts 25 and the nuts 26 for fixing the tensile joining portions 21 abutting on each other are also separated from the flanges 31 and 33 close to the steel pipe column 5 and do not interfere with each other.

For this reason, according to this embodiment, it is possible to allow the steel H-beam 3 to more approach the column surface of the steel pipe column 5. By allowing the steel H-beam 3 to more approach the column surface of the steel pipe column 5, it is possible to reduce the load applied to the external diaphragm 1 depending on the bending moment of the steel H-beam 3 illustrated in FIG. 8. As a result, a plate thickness of each plate of the external diaphragm 1 can be reduced, so that it is possible to improve freedom of design. Furthermore, it is possible to suppress the manufacturing cost for the members of the external diaphragm 1.

In addition, by allowing the steel H-beam 3 to more approach the column surface of the steel pipe column 5, the bolt 41*a* (so-called first bolt) which is most distant from the steel pipe column 5 as illustrated in FIG. 3 can be designed to be closer to the steel pipe column 5. Furthermore, it is possible to improve freedom of design of the beam plate 22.

Figure 11A:
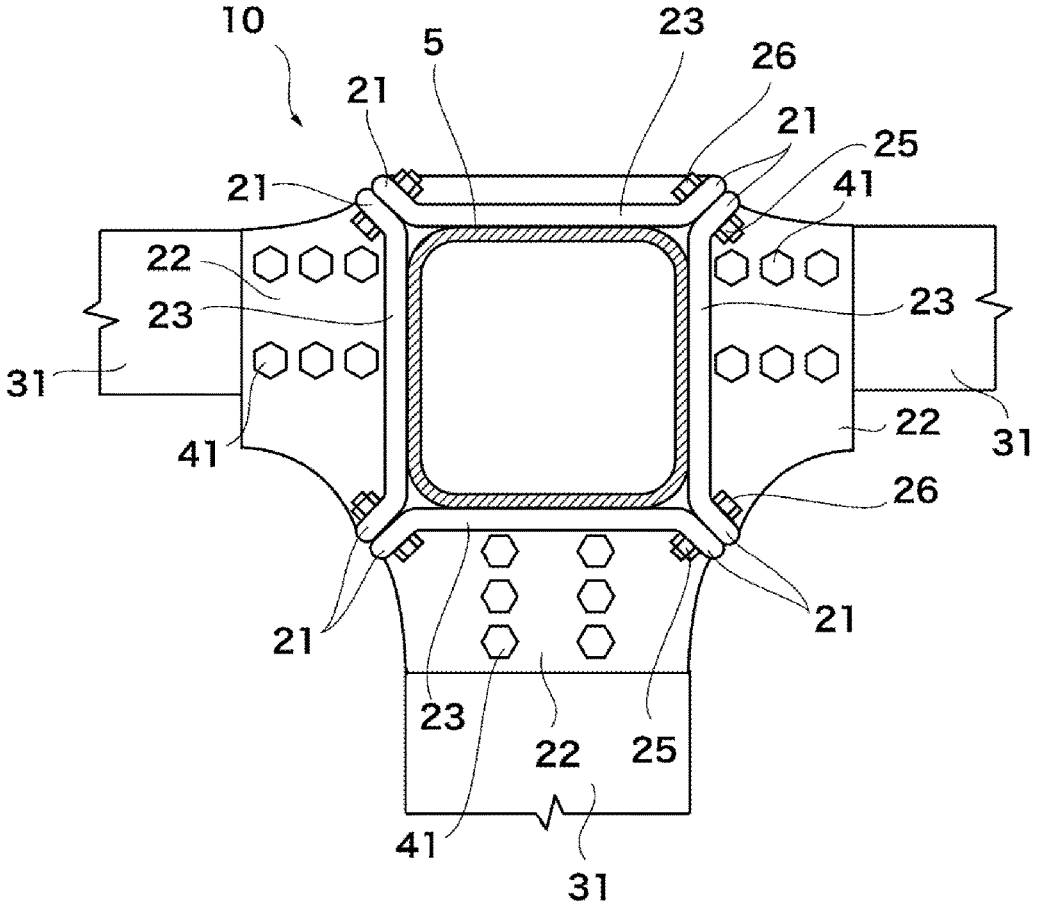
FIGS. 11A and 11B are diagrams illustrating an example in which the connection structure is applied to a corner portion of a building structure.
Figure 11B:
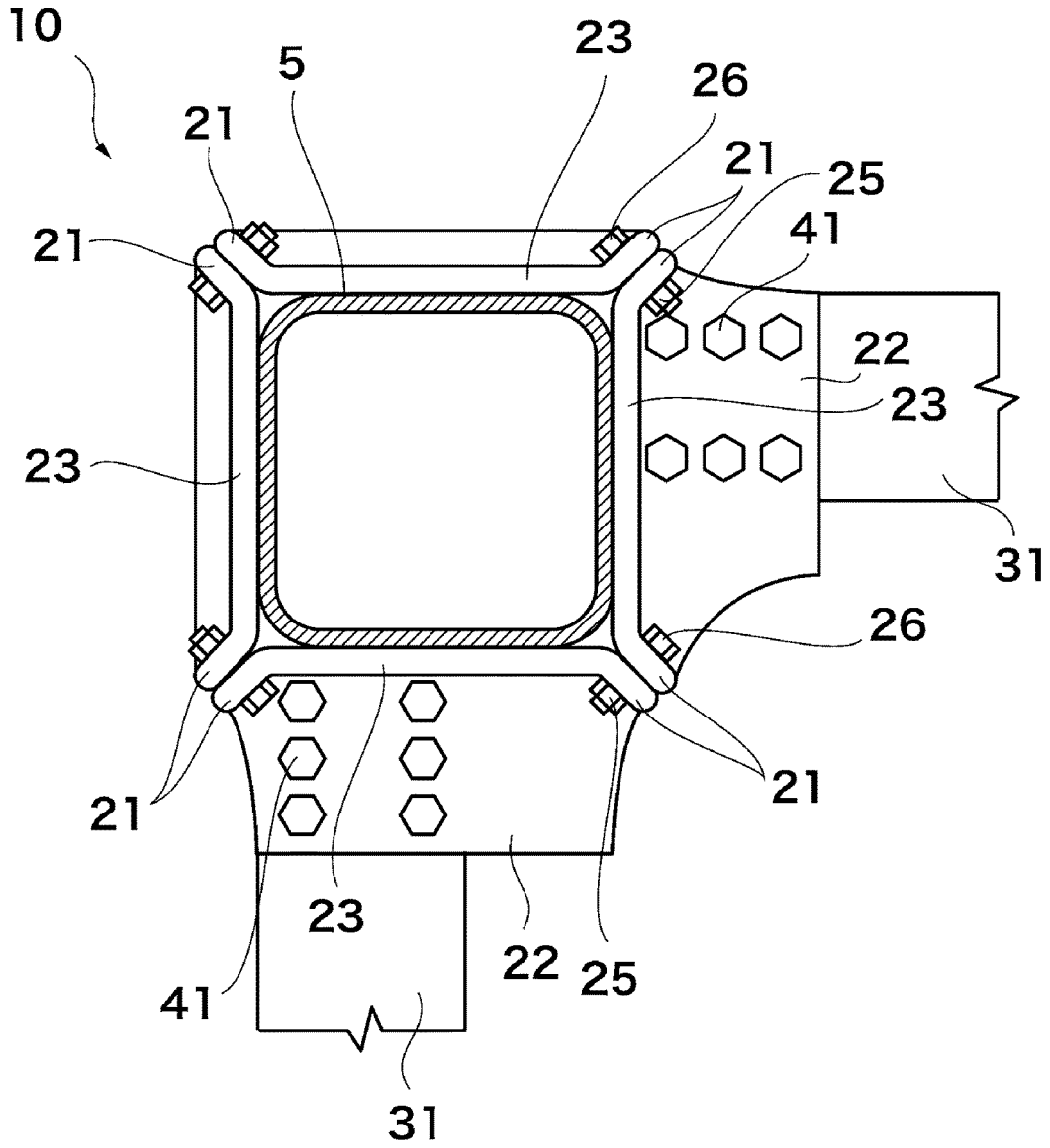

Next, another embodiment of the connection structure 10 according to the present invention will be described. FIGS. 11A and 11B illustrate an example in which the connection structure 10 is applied to a lateral portion and a corner portion of the building structure. FIG. 11A illustrates an example in which three steel H-beams 3 are installed in the steel pipe column 5 in a T-shape as seen in a plan view, and FIG. 11B illustrates an example in which two steel H-beams 3 are installed in the steel pipe column 5 in an L-shape as seen in a plan view. In such a corner portion, in order to obtain a wider interior space of the building structure, the steel H-beam 3 may be placed to deviate from the center of the steel pipe column 5 in some cases. Accordingly, the diaphragm segments 2 do not have the same shape with each other. Even in this case, according to the present invention, a single beam plate 22 and a single upper flange 31 or lower flange 33 are mated with each other one by one. Therefore, such a case can be easily coped by merely changing the positions of the bolt holes 127 toward any one side of the direction W.

A shape of the diaphragm segment 2 abutting on the column surface provided with no steel H-beam 3 is not particularly limited. The beam plate 22 for splicing to the flange 31 or 33 may be formed smaller, or the beam plate 22 itself may be eliminated. That is, according to the present invention, when the diaphragm segment 2 abuts on at least the column surface of the steel pipe column 5 where the steel H-beam 3 is connected, the beam plate 22 installed in the flange 31 or 33 of the steel H-beam 3 may be provided. That is, only the diaphragm segment 2 arranged along the steel H-beam 3 among a plurality of diaphragm segments 2 may have the beam plate 22. In addition, when the diaphragm segment 2 abuts on the column surface of the steel pipe column 5 where the steel H-beam 3 is not connected, the beam plate 22 may be eliminated. Even when the diaphragm segment 2 abuts on the column surface where the steel H-beam 3 is not provided, the aforementioned effect can be obtained by fastening the joining members such as the bolts 25 and the nuts 26 and fixing the diaphragm segments 2 such that a contact pressure is applied from the column plate 23 to the column surface of the steel pipe column 5. In order to similarly provide the stress transfer performance, it is desirable that the diaphragm segments 2 positioned on the stress transfer path of the tensile force have substantially the same cross-sectional area.

Figure 12A:
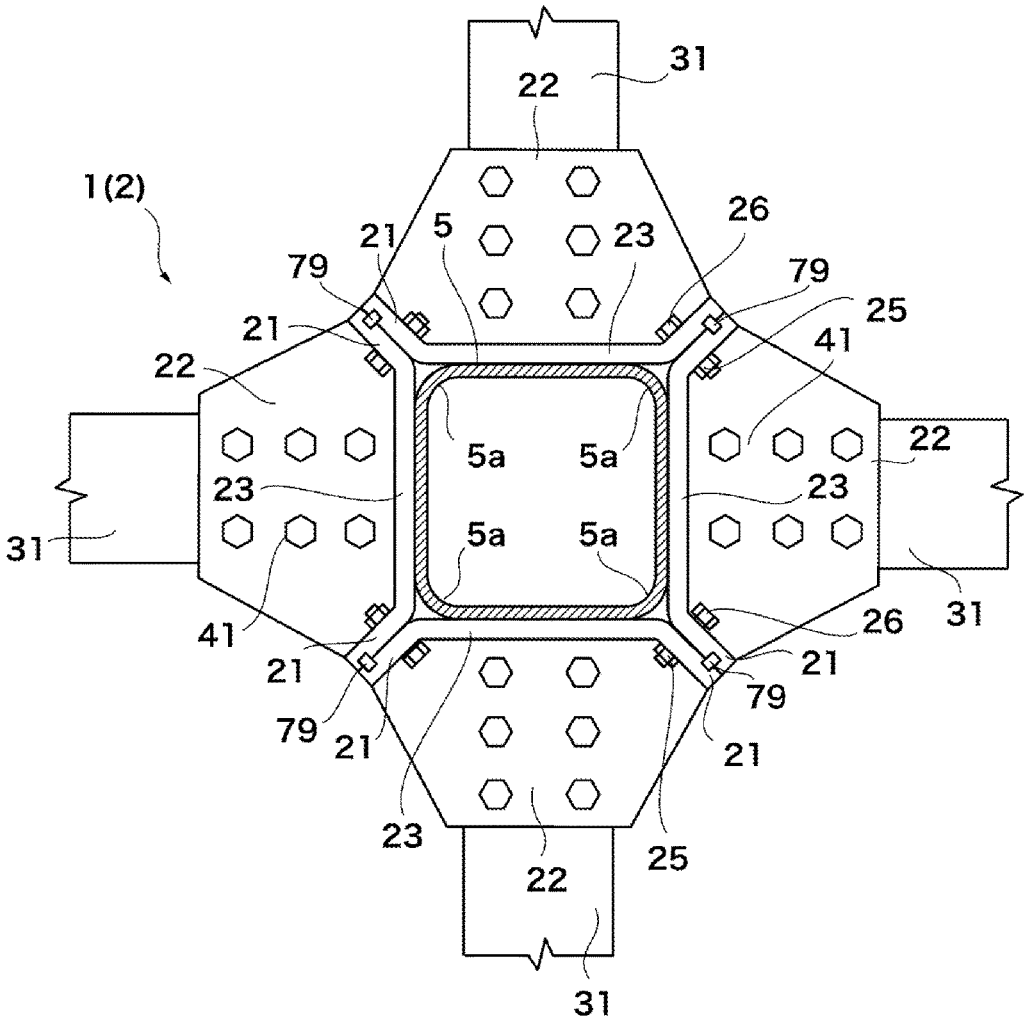
FIGS. 12A-12C are diagrams illustrating an example in which a stress transfer mechanism for transferring a shearing force is provided between tensile joining portions.
Figure 12B:
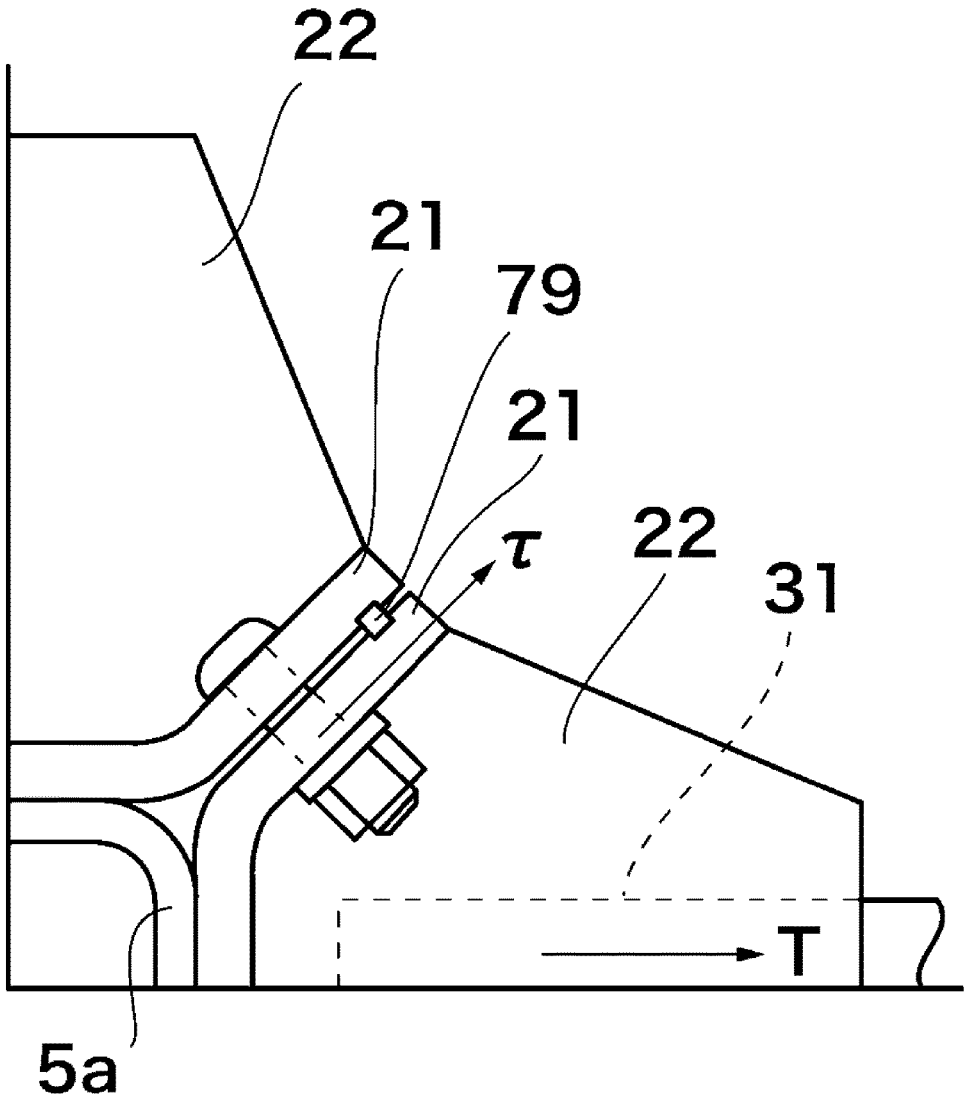

As another embodiment of the connection structure 10 according to the present invention, for example, a stress transfer mechanism 79 for transferring a shearing force between the tensile joining portions 21 may be provided as illustrated in FIG. 12A. As illustrated in FIG. 12B, when a tensile force T is applied from the steel H-beam 3, a direction of the tensile force T described above is at an angle of approximately 45° to the pulling direction between the bolt 25 and the nut 26. Therefore, a shearing force $\tau$ is applied between the tensile joining portions 21 in response to such a load of the tensile force T. This stress transfer mechanism 79 transfers the shearing force $\tau$ applied between the tensile joining portions 21 abutting on each other. The stress transfer mechanism 79 resists to each tensile joining portion 21 trying to displace in a shearing direction with each other based on the shearing force $\tau$. This makes it possible to suppress deviation between the diaphragm segments 2 and secure stiffness and a yield strength between the tensile joining portions 21 making surface contact with each other. As a result, it is possible to alleviate the shearing force applied to the bolt 25.

This stress transfer mechanism 79 is provided in a side which is distant from the steel pipe column 5 rather than the bolt 25. The stress transfer mechanism 79 may include, for example, a pin inserted into a hole formed when the tensile joining portions 21 abut on each other. In addition, the stress transfer mechanism 79 may have, for example, a concavo-convex shape that can be engaged with each other. If the stress transfer mechanism 79 having such a concavo-convex shape engaged with each other is provided between the tensile joining portions 21, the shearing force that can be transferred between the tensile joining portions 21 also increases, so that it is possible to effectively transmit the shearing force applied thereto.

Alternatively, the stress transfer mechanism 79 may have any shape as long as the shearing force can be transferred with each other without limiting to the concavo-convex shape described above. In addition, although the stress transfer mechanism 79 may be provided in any position of the tensile joining portion 21, it is desirable that the stress transfer mechanism 79 is provided outside the bolt 25 and the nut 26 as illustrated in FIG. 12A. This is because, when a tensile force is applied to the bolt 25 and the nut 26, a stronger compressive force is applied to the outside of the bolt 25 and the nut 26 by a lever reaction force, so that a higher shearing resistance can be expected in this position.

According to the present invention, so-called high-strength bolt tension connection may be performed between the bolt 25 and the nut 26. Accordingly, as a result of applying the tensile force T described above, even when a tensile force is applied to the bolt 25 and the nut 27, it can be absorbed. Therefore, it is possible to prevent displacement of the diaphragm segment 2.

As described above, according to the present invention, it is possible to perform an assembly work using bolt joining without welding. Therefore, it is possible to absorb forces generated in various places by combining high-strength bolt joining. Furthermore, it is possible to improve a yield stress of the entire connection structure 10 against an earthquake or the like.

According to the present invention, the external diaphragm 1 described above is installed in each of the upper flange 31 and lower flange 33 of the steel H-beam 3. Therefore, when a bending moment based on a vibration is applied to the steel H-beam 3 in the event of an earthquake, it is possible to expect the aforementioned effects in each of the upper flange 31 side and lower flange 33 side.

Figure 13A:
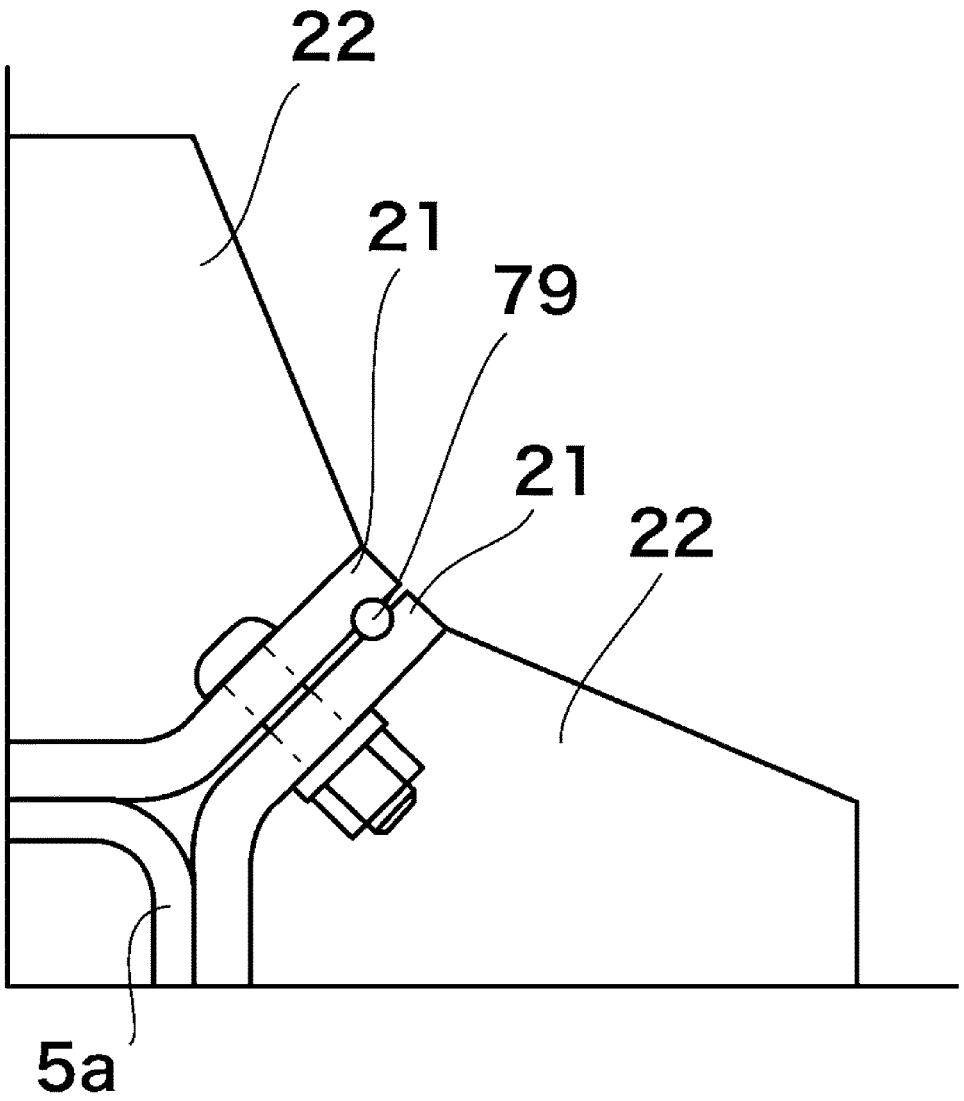
FIGS. 13A-13D are diagrams illustrating another example of the stress transfer mechanism.
Figure 13B:
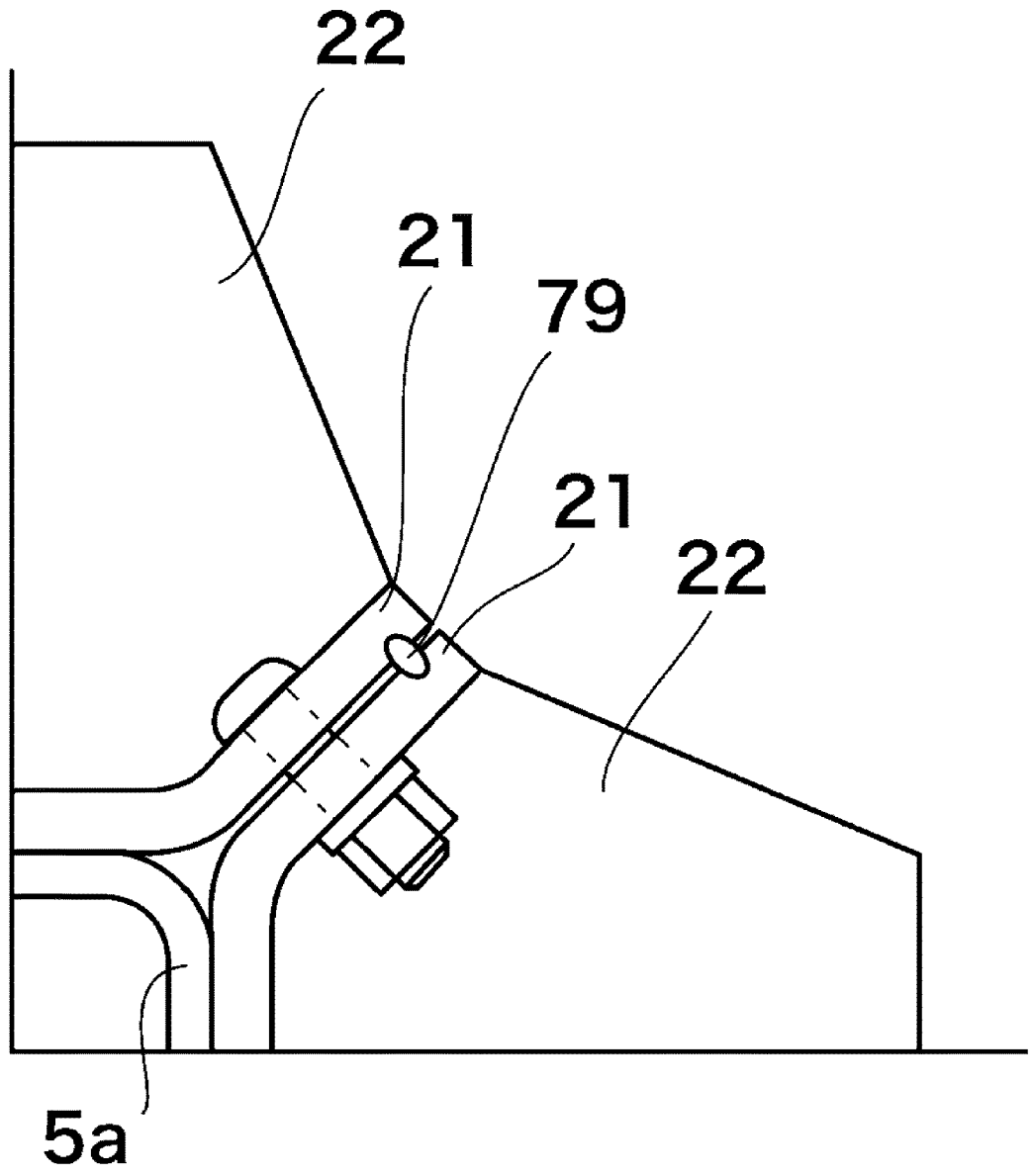
Figure 13C:
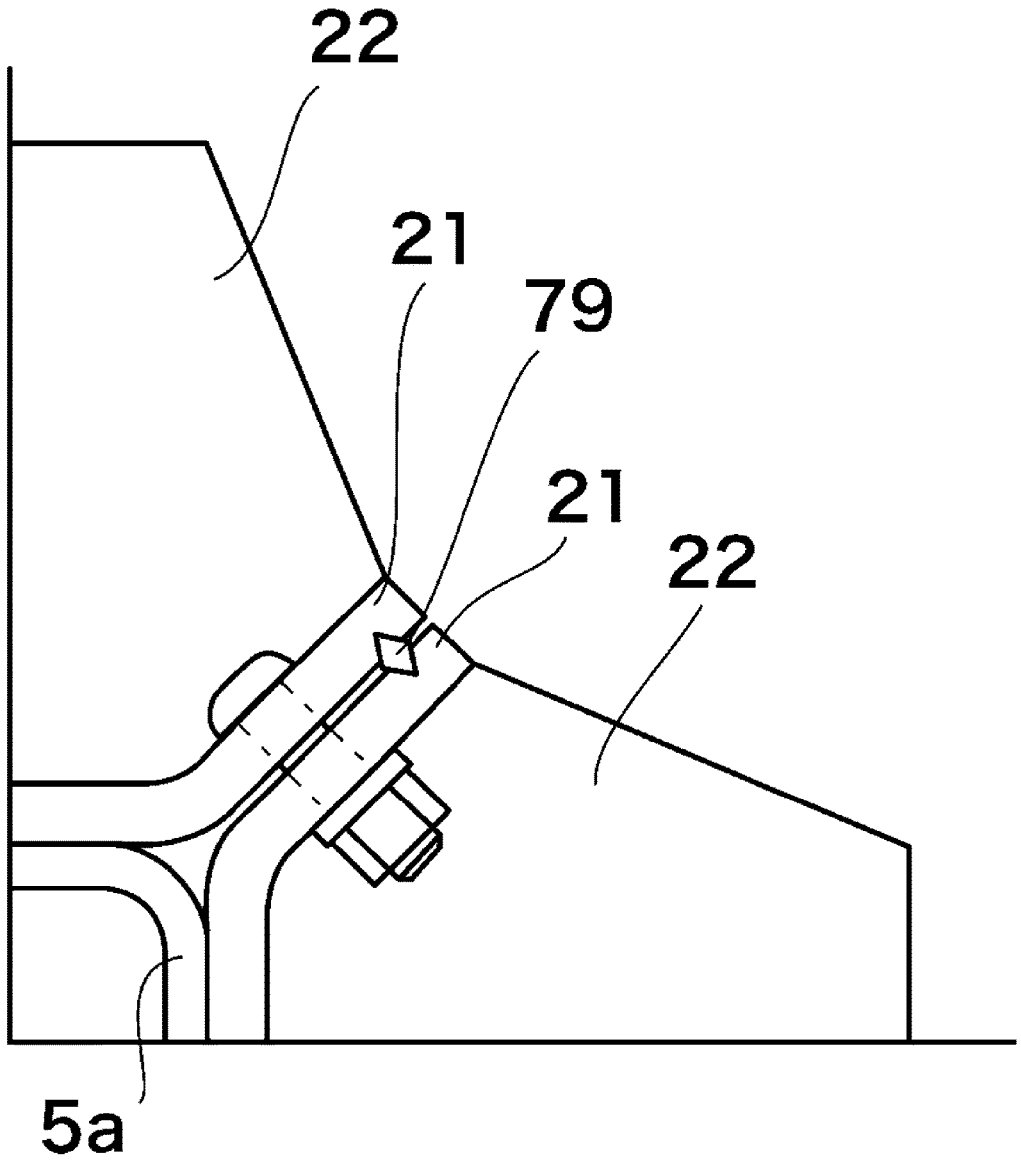
Figure 13D:
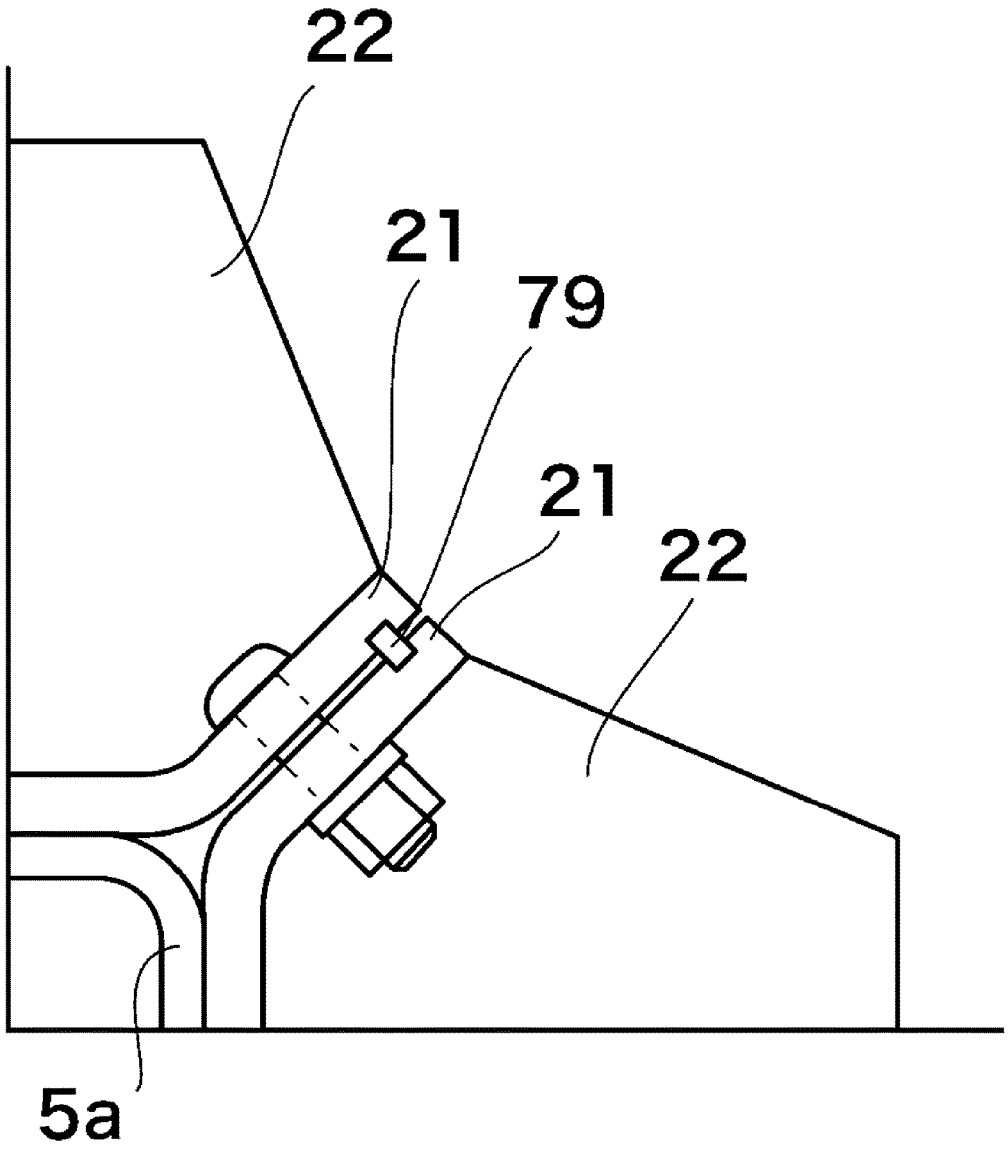
Figure 14A:
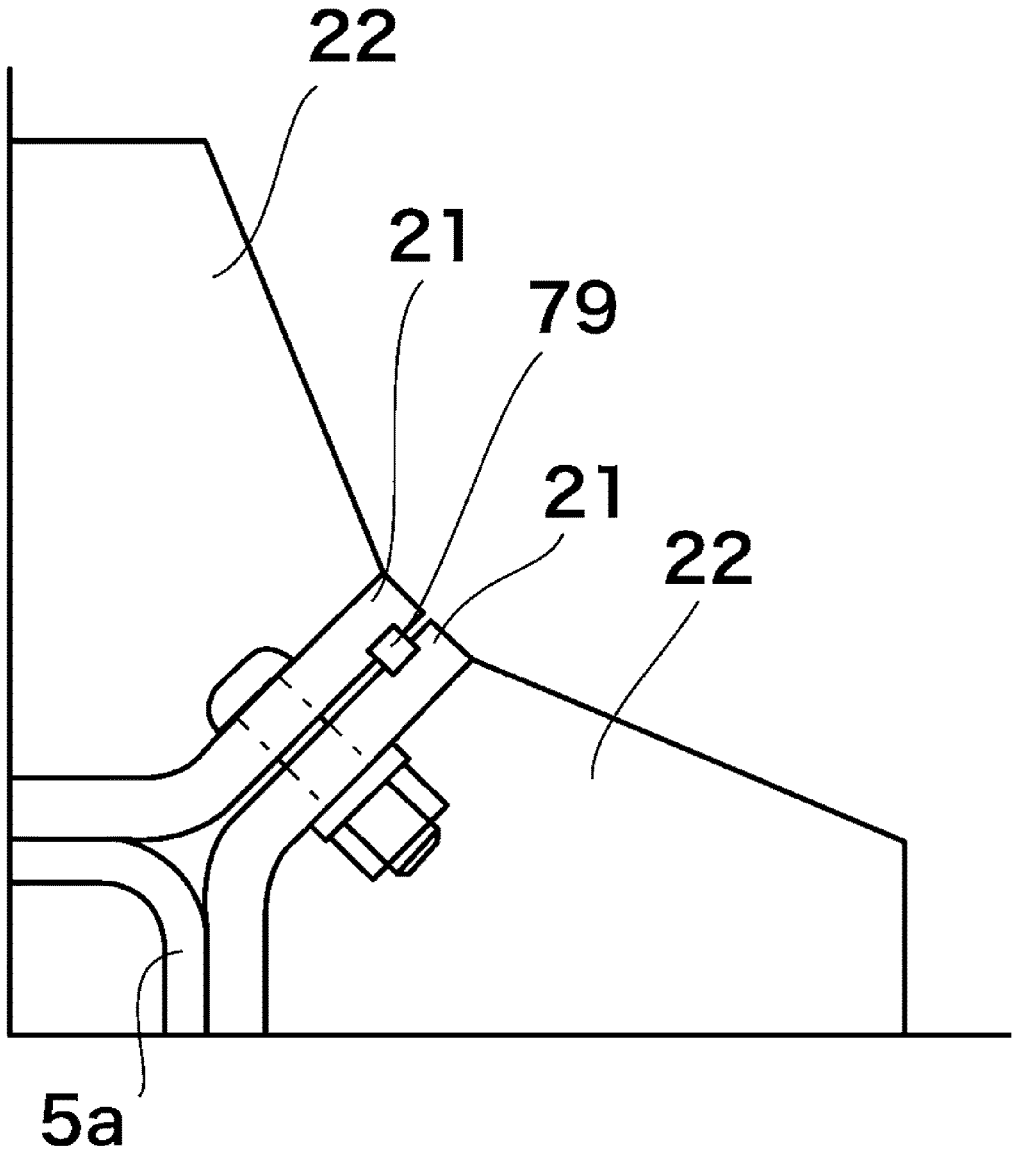
FIGS. 14A-14C are diagrams illustrating still another example of the stress transfer mechanism.
Figure 14B:
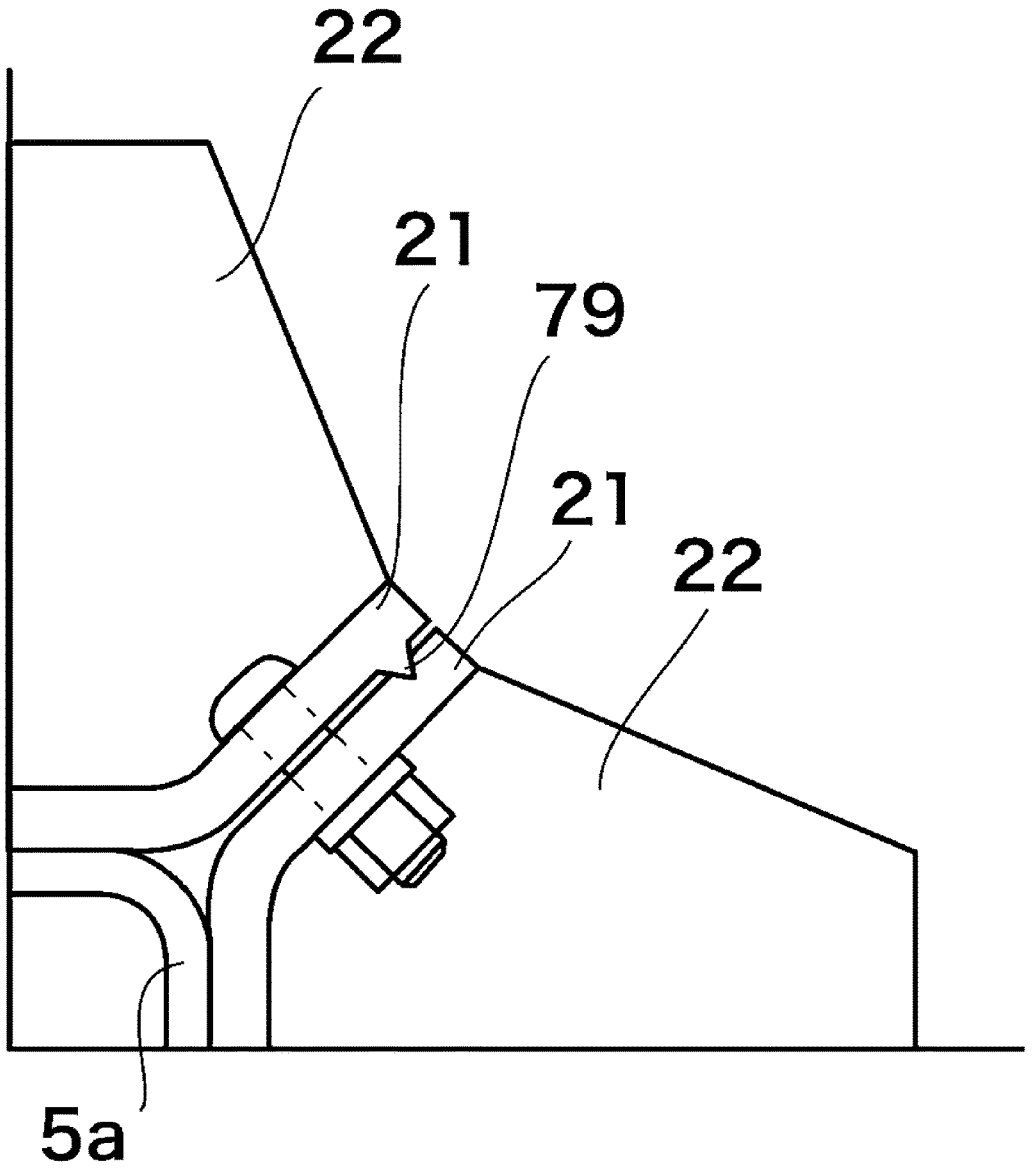
Figure 14C:
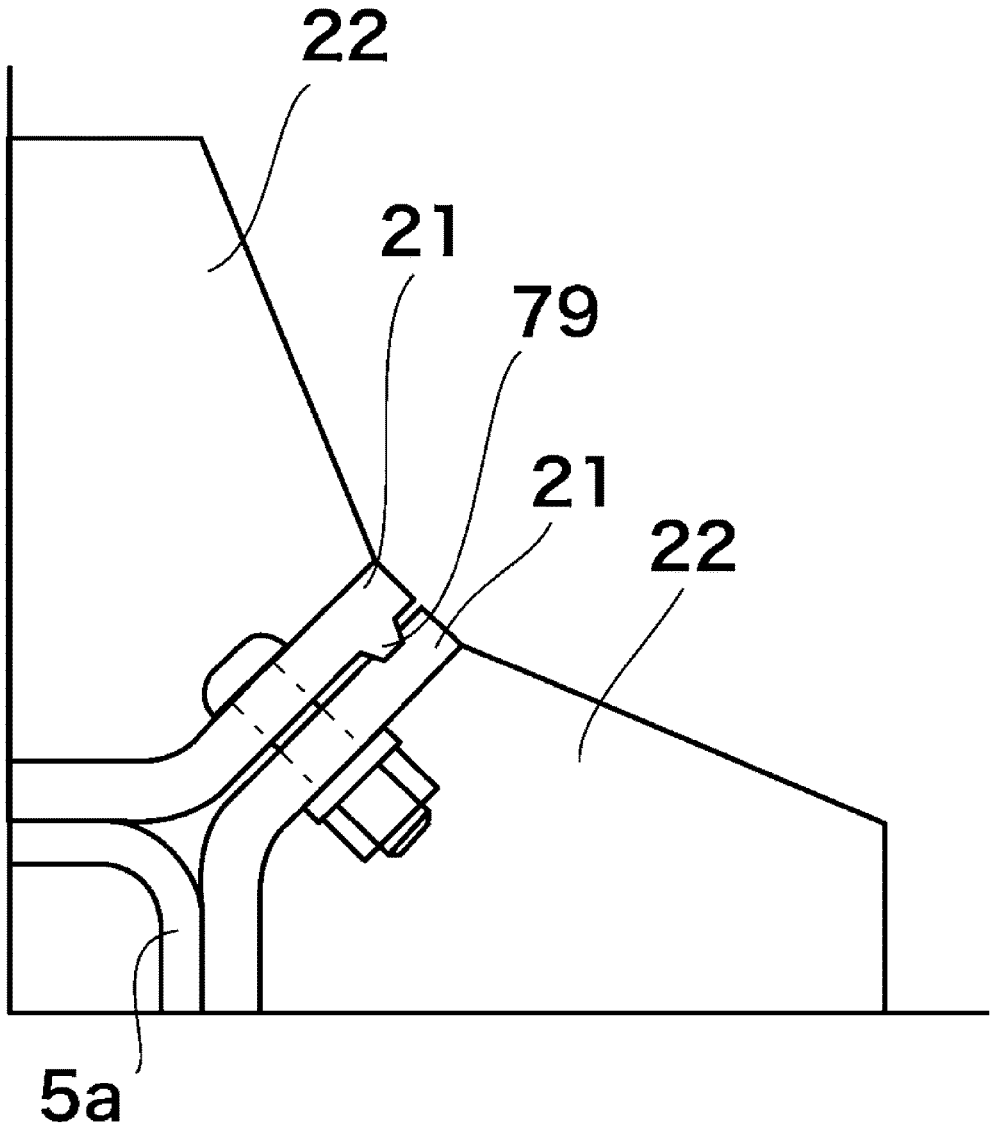

FIGS. 13A-13D and 14A-14C illustrate another example of the stress transfer mechanism 79. FIG. 13A illustrates an example in which a cross-sectional shape of the stress transfer mechanism 79 is circular, FIG. 13B illustrates an example in which a cross-sectional shape of the stress transfer mechanism 79 is elliptical, FIG. 13C illustrates an example in which a cross-sectional shape of the stress transfer mechanism 79 is a diamond shape, and FIG. 13D illustrates an example in which a cross-sectional shape of the stress transfer mechanism 79 is rectangular. In addition, FIG. 14A illustrates an example in which a cross-sectional shape of the stress transfer mechanism 79 is square, FIG. 14B illustrates an example in which the stress transfer mechanism 79 having a triangular cross-sectional shape is integrated to the tensile joining portion 21, and FIG. 14C illustrates an example in which the stress transfer mechanism 79 having a trapezoidal cross-sectional shape is integrated into the tensile joining portion 21. However, in the examples of FIGS. 14B and 14C, the stress transfer mechanism 79 and the tensile joining portion 21 may be formed as separate members naturally.

In the stress transfer mechanisms 79 having the circular, elliptical, diamond, rectangular, and square cross-sectional shapes, it is desirable that the center of each shape is arranged to pass over the contact surface of the tensile joining portions 21 making surface contact with each other, but not limited thereto.

Meanwhile, in the stress transfer mechanism 79 having a triangular cross-sectional shape of FIG. 14B and the stress transfer mechanism 79 having a trapezoidal cross-sectional shape of FIG. 14C, it is desirable that an outer circumferential surface of such a diagonal shape is arranged to pass over the contact surface of the tensile joining portions 21 making surface contact with each other, but not limited thereto.

Figure 12C:
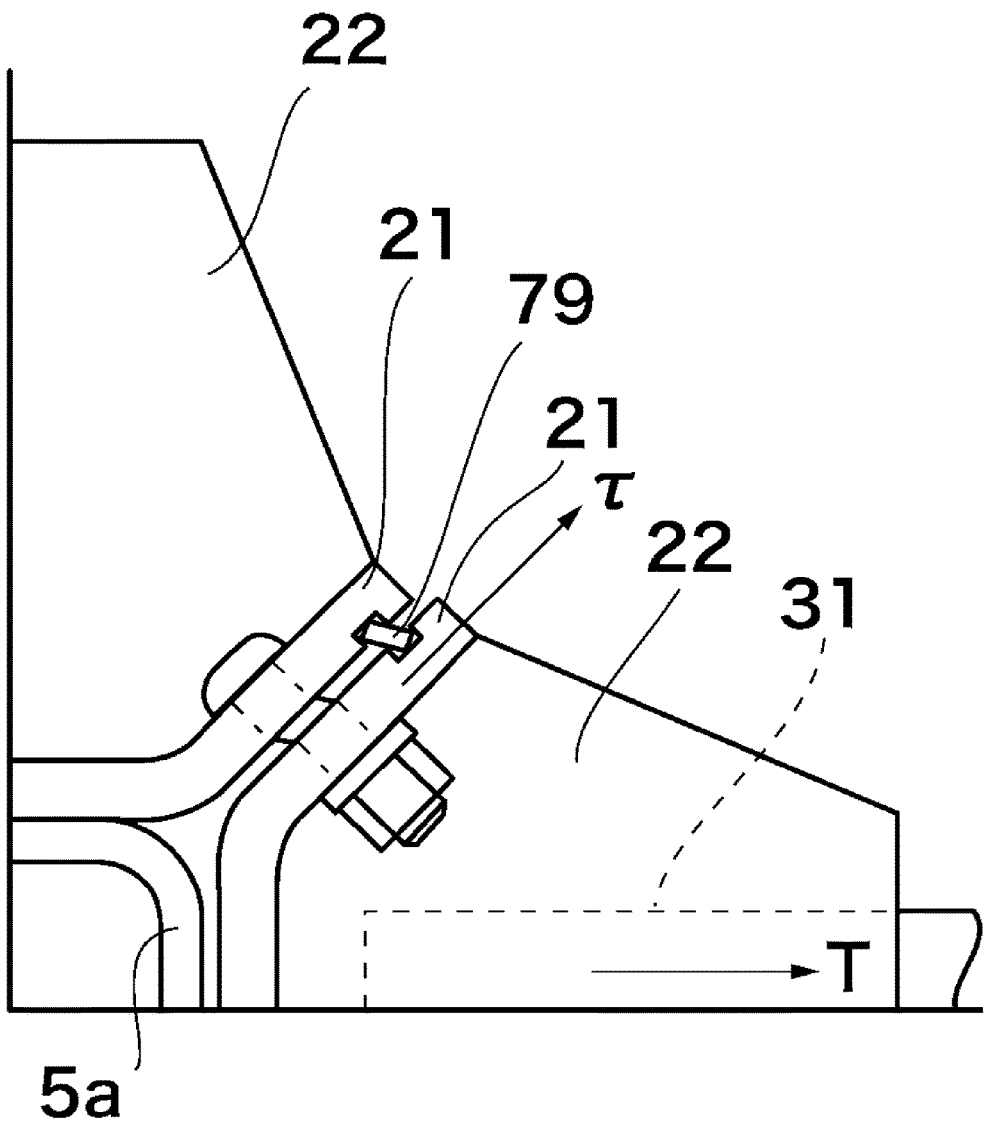

Even when the shearing force $\tau$ is very strong due to an earthquake or the like, and the displacement of the bolt precedes the displacement between the diaphragm segments 2 as illustrated in FIG. 12C, it is possible to resist to the displacement between the diaphragm segments 2 in the shearing direction, for example, using the stress transfer mechanism 79 having a rectangular or square cross-sectional shape.

Figure 15:
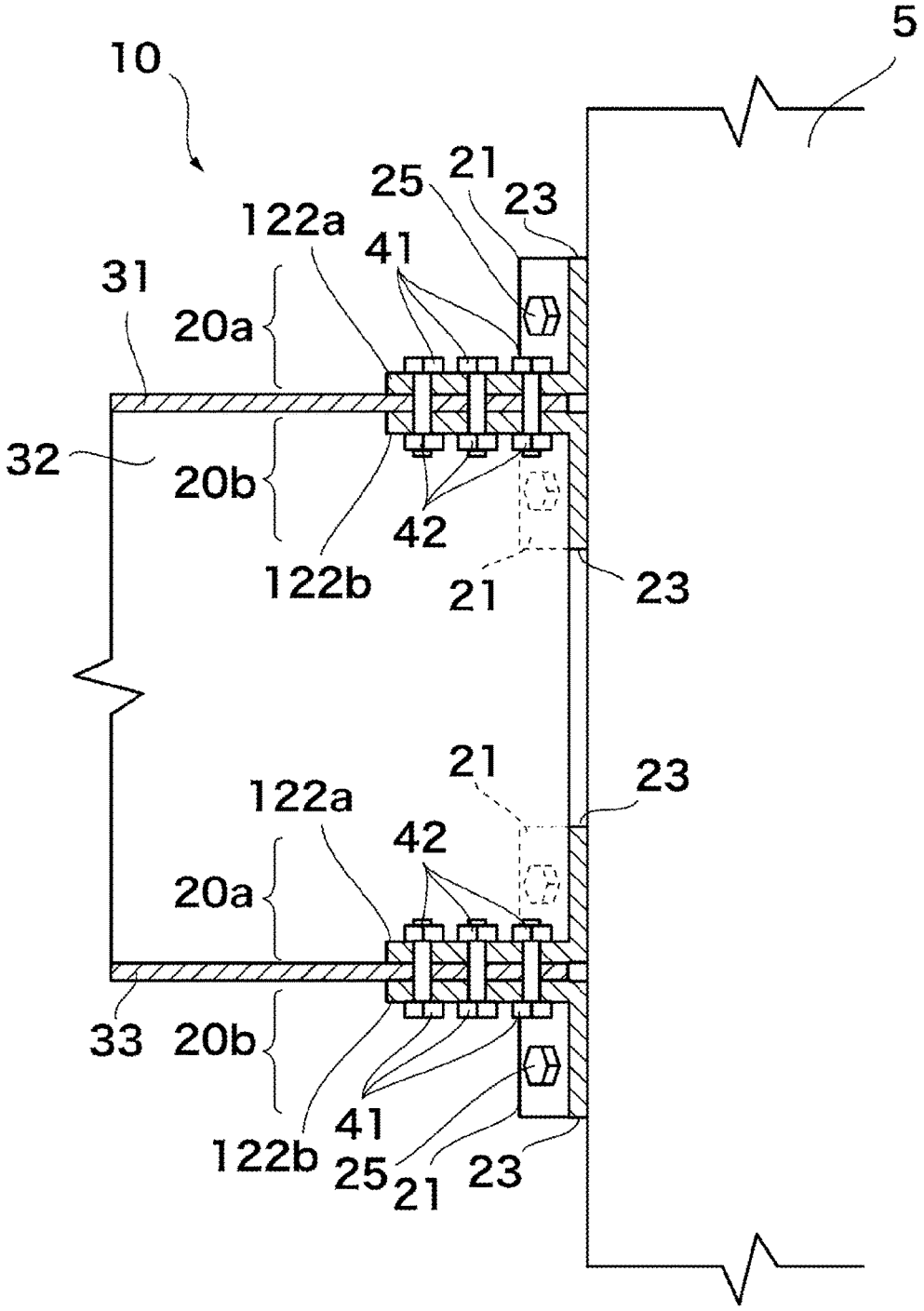
FIG. 15 is a diagram illustrating an example in which a connection structure according to the present invention is connected to a steel H-beam on the basis of a so-called double-side frictional connection.

FIG. 15 illustrates an example in which the connection structure 10 according to the present invention is connected to the steel H-beam 3 on the basis of a so-called double-side frictional joining.

In this example, the diaphragm segment 20*a* is spliced to the upper surface, and the diaphragm segment 20*b* is spliced to the lower surface of each of the flanges 31 and 33 of the steel H-beam 3. The diaphragm segments 20*a* and 20*b* are formed in a shape obtained by dividing the diaphragm segment 2 into two parts with respect to the beam plate 22. In the description of the diaphragm segments 20*a* and 20*b*, like reference numerals denote like elements as in the diaphragm segment 2 described above, and they will not be described repeatedly.

The diaphragm segment 20*a* has a beam plate 122*a*, and the beam plate 122*a* is spliced to the upper surface of the flange 31 or 33. The diaphragm segment 20*b* has a beam plate 122*b*, and the beam plate 122*b* is spliced to the lower surface of the flange 31 or 33. Each of the beam plates 122*a* and 122*b* is provided with bolt holes (not shown), and is installed in the flange 31 or 33 using the bolts 41 and the nuts 42 through the bolt holes.

In the connection structure 10 having such a configuration, the beam plates 122 are spliced to the both surfaces of the flanges 31 and 33. Therefore, a total contact area between the flanges 31 and 33 and the beam plates 122*a* and 122*b* increases. As a result, when an axial force (including the tensile force T and the compressive force P) is applied through the flanges 31 and 33 as described above, it is possible to exert a stronger frictional force between the flanges 31 and 33 and the beam plates 122*a* and 122*b*. Since such an increase in frictional force can be expected, it is also possible to reduce the number of bolts 41 and nuts 42.

Figure 16:
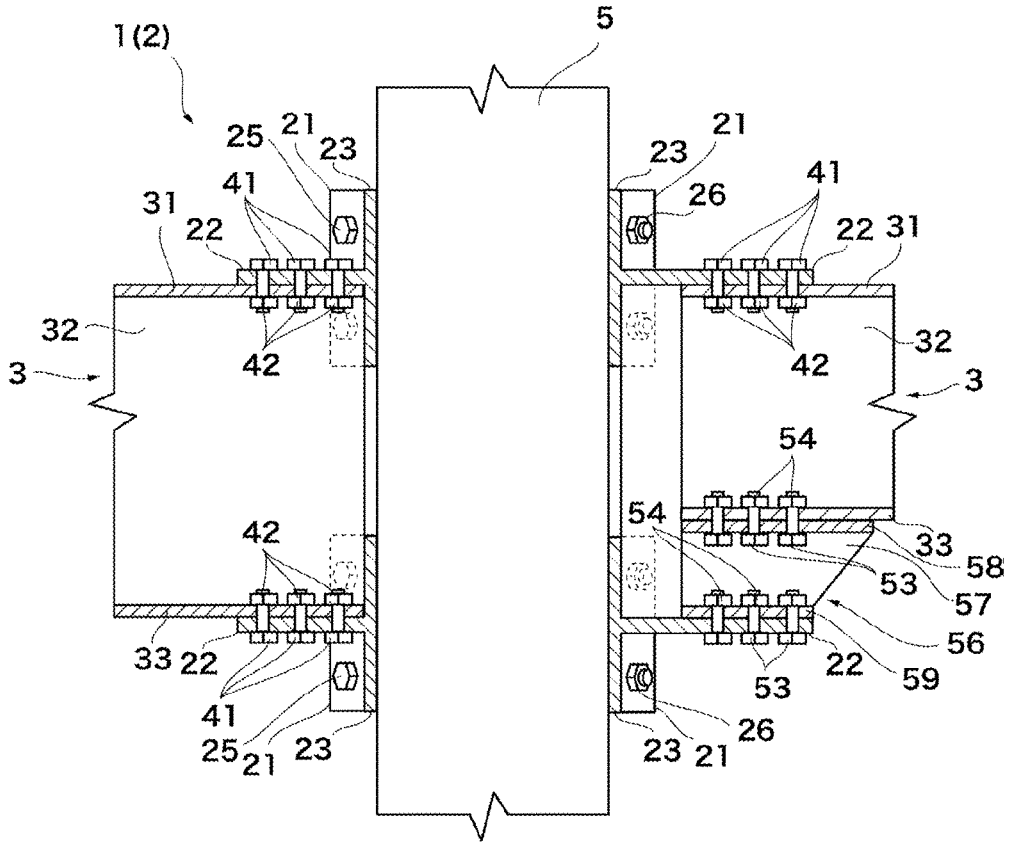
FIG. 16 is a cross-sectional side view illustrating an example in which steel H-beams having different heights are installed in the steel pipe column.

FIG. 16 is a cross-sectional side view illustrating an example in which steel H-beams 3 having different heights are installed in the steel pipe column 5. The steel H-beam 3 having a larger height is installed in the external diaphragm 1 based on the same method as described above. Specifically, an upper limit distance of the external diaphragm 1 provided over and under the steel H-beam 3 depends on the steel H-beam 3 having a larger height. For this reason, a gap is formed between the steel H-beam 3 and the external diaphragm 1 because a vertical distance between the external diaphragm 1 and the steel H-beam 3 having a smaller height becomes wider. For this reason, the gap is eliminated by inserting another member between the steel H-beam 3 and the external diaphragm 1.

In the example of FIG. 16, an insert member 56 obtained by cutting out the H-shaped steel is interposed between the steel H-beam 3 and the diaphragm segment 2. The insert member 56 is formed to have flanges 58 and 59 at the upper and lower ends of web 57. The flange 58 is connected to the lower flange 33 of the steel H-beam 3 by bolts 53 and nuts 54, and the flange 59 is connected to the beam plate 22 of the diaphragm segment 2 by bolts 53 and nuts 54. Note that the insert member 56 is fixed to the column plate 23 while they are separated from each other without making contact with each other.

In this configuration, in response to a tensile stress transferred from the lower flange 33, a tensile stress is similarly applied to the beam plate 22 of the diaphragm segment 2 through the insert member 56, so that the same effects as those described above can be obtained. In addition, when a compressive stress is transferred from the lower flange 33, it is transferred to the beam plate 22 through the insert member 56 and is directly transferred to the steel pipe column 5.

Figure 17A:
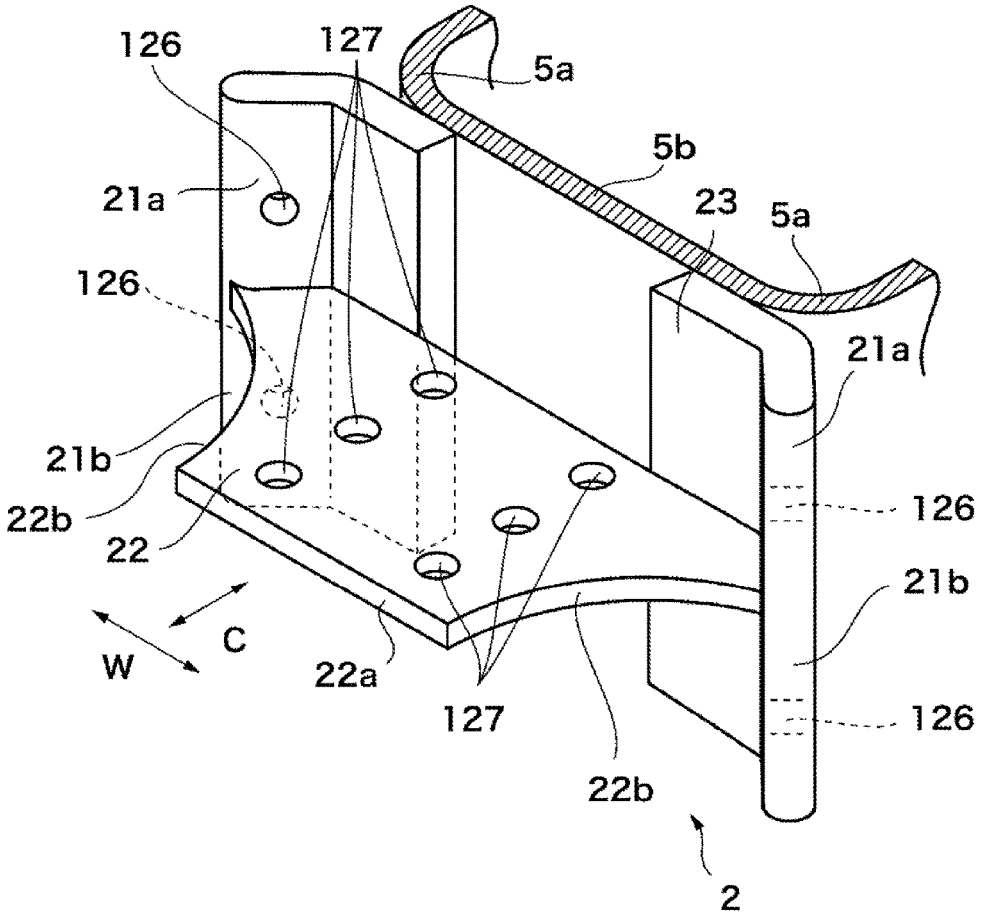
FIGS. 17A and 17B are diagrams illustrating an example in which a vertical width of the column plate is set to be wider in a corner portion side of the steel pipe column and be narrower in a center portion side of the steel pipe column.
Figure 17B:
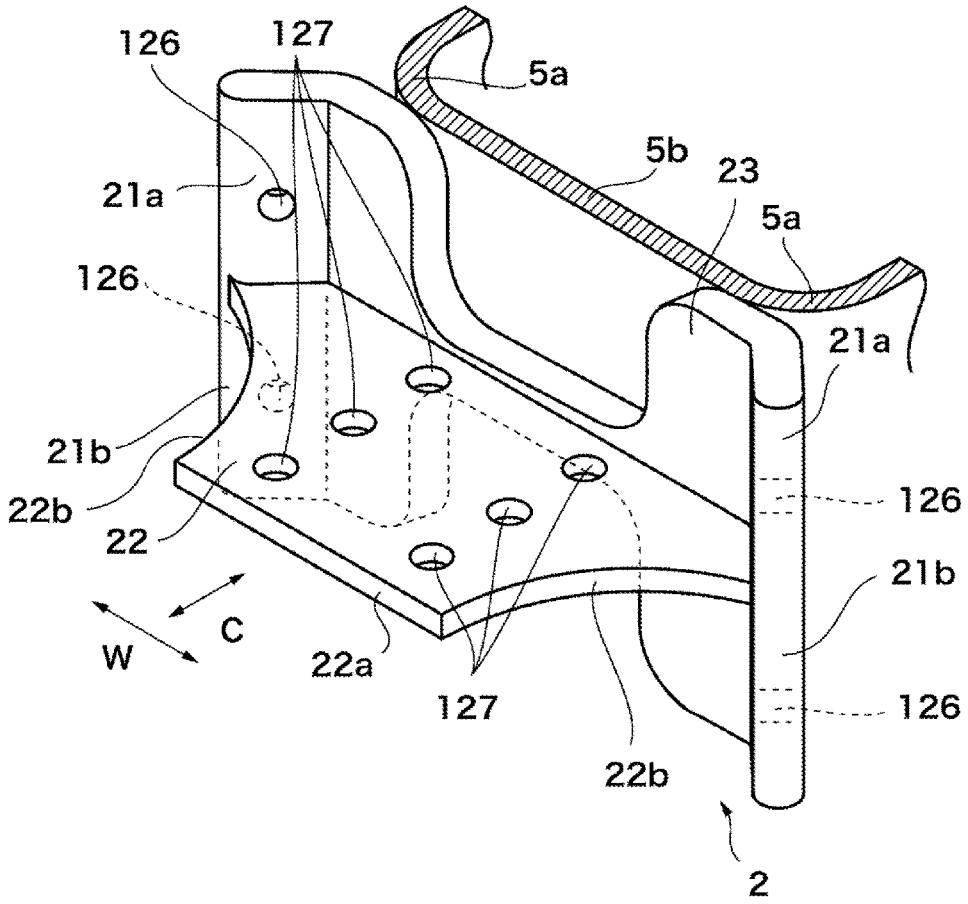

In the example of FIGS. 17A and 17B, a vertical width of the column plate 23 is wider in the corner portion 5*a* side of the steel pipe column 5 and is narrower in the center portion 5*b* of the steel pipe column. In FIG. 17A, the column plate 23 is perfectly removed in the vicinity of the center portion 5*b* of the steel pipe column 5, and the beam plate 22 is separated from the steel pipe column 5. In FIG. 17B, the vertical width of the column plate 23 is gradually narrowed along the center portion 5*b* from the corner portion 5*a* of the steel pipe column 5. In either case, the column surface of the steel pipe column 5 in the vicinity of the corner portion 5*a* receives a higher contact pressure from the column plate 23, so that an excessive contact pressure is not applied from the column plate 23 to the portions other than the corner portion 5*a* (for example, the center portion 5*b*). As a result, it is possible to reduce a weight of the column plate 23, cost of the materials, or transportation efficiency. In addition, it is possible to reduce the welding amount when the column plate 23 and the beam plate 22 are welded. Therefore, it is possible to reduce the welding material or the welding time. Furthermore, as a merit in terms of construction, since handling becomes easier by reducing the weight of the diaphragm segment, and it is possible to improve workability of a construction worker.

Figure 18:
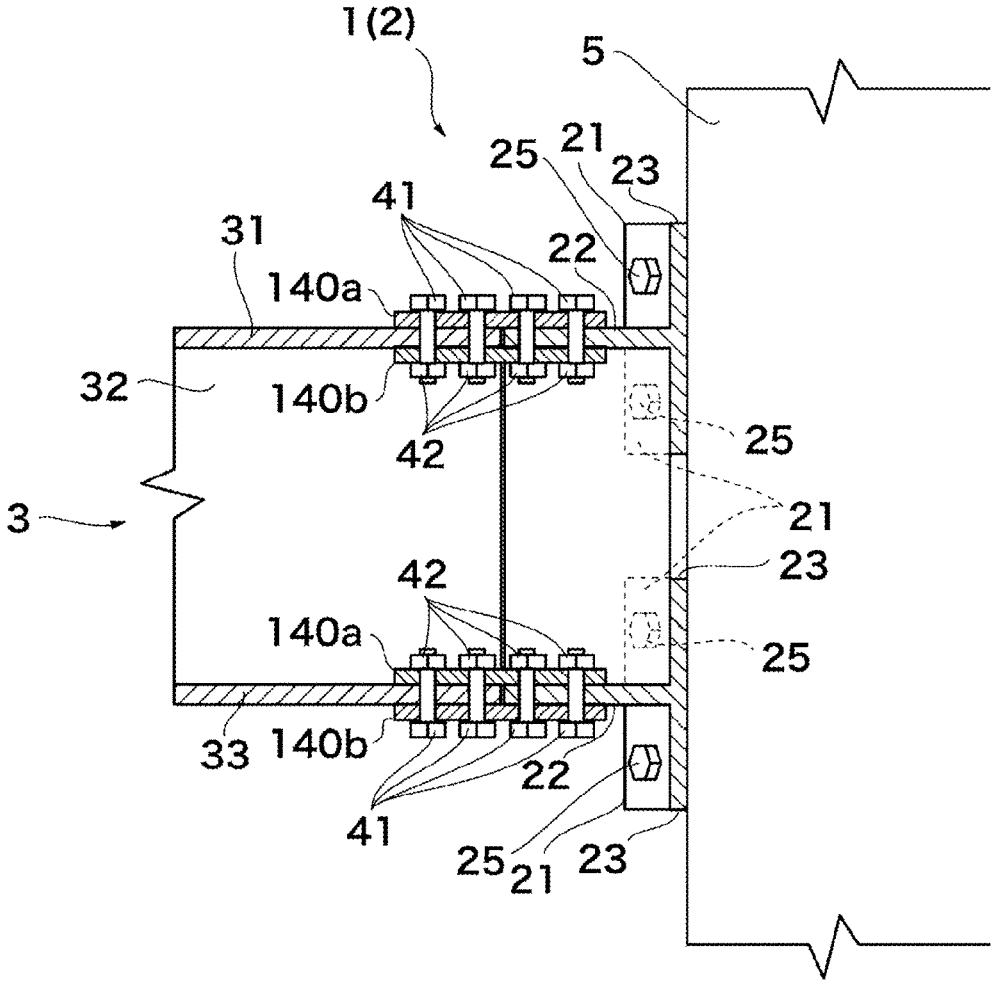
FIG. 18 is a diagram for describing an example in which the diaphragm segment is installed in the steel H-beam using a splice plate.

The connection structure 10 according to the present invention may also be implemented as illustrated in FIG. 18. In this configuration, a splice plate 140*a* is spliced to the upper surface of the beam plate 22, and a splice plate 140*b* is spliced to the lower surface of the beam plate 22. In addition, the flanges 31 and 33 of the steel H-beam 3 are interposed between the splice plates 140*a* and 140*b*. In addition, the splice plate 140*a*, the beam plate 22, and the splice plate 140*b* are joined to each other with bolts 41 and nuts 42, and the splice plate 140*a*, the flanges 31 and 33, and the splice plate 140*b* are joined to each other with bolts 41 and nuts 42.

In this manner, the beam plate 22 is installed in the flanges 31 and 33 of the steel H-beam 3 using the splice plates 140*a* and 140*b*. Even in this configuration, it is possible to obtain the aforementioned effects.

In the connection structure 10 according to the present invention, it is assumed that the external diaphragm 1 is installed in the steel pipe column 5 formed from a polygonal steel pipe by way of example. However, without limiting thereto, this may similarly apply to a column of a reinforced concrete structure. Even in this case, the same functions can be obtained by allowing the column plate 23 of the diaphragm segment 2 to abut on the column and applying a contact pressure from the column plate 23 to the column.

The present invention is also applicable to a concrete-filled steel pipe structure (CFT) instead of the steel pipe column 5.

REFERENCE SIGNS AND NUMERALS

1 external diaphragm
2 diaphragm segment
3 steel H-beam
5 steel pipe column
10 connection structure
20 *a*, 20 *b* diaphragm segment
21 tensile joining portion
22 beam plate
23 column plate
25, 41 bolt
26, 27, 42 nut
31 upper flange
32 web
33 lower flange
79 stress transfer mechanism
122 *a*, 122 *b* beam plate
126, 127 bolt hole
140 *a*, 140 *b* splice plate

The invention claimed is:

1. A column and beam connection structure for connecting a steel H-beam to a column using an external diaphragm, the column having a uniform rectangular cross-sectional shape along its entire length with four external surfaces meeting at corner portions, wherein:

the external diaphragm comprises a plurality of diaphragm segments;

each of the diaphragm segments comprises a column plate abutting on the column;

one of the plurality of diaphragm segments is arranged along the steel H-beam and comprises a beam plate installed on a flange of the steel H-beam, the beam plate having an end portion at which the column plate of the one of the diaphragm segments is provided;

joining locations between adjacent ones of the diaphragm segments are placed in vicinities of the corner portions of the column, such that each of the external surfaces of the column abuts the column plate of only one of the diaphragm segments;

joining members are fastened to fix between the adjacent ones of the diaphragm segments, such that contact pressure is applied from the column plates of the diaphragm segments to the external surfaces of the column; and the diaphragm segments abut on the column via the respective column plates thereof to be fixed to the column, and the column plates are not directly connected to the column by any joining member and are not directly connected to the column by welding.

2. The column and beam connection structure according to claim 1, wherein:

each of the diaphragm segments further comprises tensile joining portions provided at both ends of the column plate; and in the one of the diaphragm segments comprising the beam plate, the tensile joining portions are erected upward or downward from a surface of the beam plate.

3. The column and beam connection structure according to claim 2, wherein the joining members comprise bolts, each of the bolts having a tip to which a nut is screwed, and the bolts being inserted between adjacent ones of the tensile joining portions of the adjacent ones of the diaphragm segments.

4. The column and beam connection structure according to claim 3, wherein the tensile joining portions and the joining members are separated from the flange of the steel H-beam.

5. The column and beam connection structure according to claim 3, wherein stress transfer mechanisms are provided between the adjacent ones of the tensile joining portions of the adjacent ones of the diaphragm segments, wherein the stress transfer mechanisms are configured to transfer a shearing force to a side separated from the column.

6. The column and beam connection structure according to claim 1, wherein the diaphragm segments are not glued to the column.

7. The column and beam connection structure according to claim 2, wherein the diaphragm segments are not glued to the column.

8. The column and beam connection structure according to claim 3, wherein the diaphragm segments are not glued to the column.

9. The column and beam connection structure according to claim 4, wherein the diaphragm segments are not glued to the column.

10. The column and beam connection structure according to claim 5, wherein the diaphragm segments are not glued to the column.

11. The column and beam connection structure according to claim 1, wherein:

the external diaphragm is configured such that gaps are formed between the adjacent ones of the diaphragm segments arranged around the column while the column plates abut on the column; and the joining members are configured to reduce the gaps when fastened between the adjacent ones of the diaphragm segments, to generate the contact pressure applied from the column plates to the external surfaces of the column.

12. The column and beam connection structure according to claim 2, wherein:

the external diaphragm is configured such that gaps are formed between the adjacent ones of the diaphragm segments arranged around the column while the column plates abut on the column; and the joining members are configured to reduce the gaps when fastened between the adjacent ones of the diaphragm segments, to generate the contact pressure applied from the column plates to the external surfaces of the column.

13. The column and beam connection structure according to claim 3, wherein:

the external diaphragm is configured such that gaps are formed between the adjacent ones of the diaphragm segments arranged around the column while the column plates abut on the column; and the joining members are configured to reduce the gaps when fastened between the adjacent ones of the diaphragm segments, to generate the contact pressure applied from the column plates to the external surfaces of the column.

14. The column and beam connection structure according to claim 4, wherein:

the external diaphragm is configured such that gaps are formed between the adjacent ones of the diaphragm segments arranged around the column while the column plates abut on the column; and the joining members are configured to reduce the gaps when fastened between the adjacent ones of the diaphragm segments, to generate the contact pressure applied from the column plates to the external surfaces of the column.

15. The column and beam connection structure according to claim 5, wherein:

the external diaphragm is configured such that gaps are formed between the adjacent ones of the diaphragm segments arranged around the column while the column plates abut on the column; and the joining members are configured to reduce the gaps when fastened between the adjacent ones of the diaphragm segments, to generate the contact pressure applied from the column plates to the external surfaces of the column.

16. The column and beam connection structure according to claim 1, wherein the external diaphragm is provided on each of upper and lower flanges of the steel H-beam.

17. The column and beam connection structure according to claim 1, wherein:

the beam plate of the one of the diaphragm segments reduces the contact pressure from the column plate of the one of the diaphragm segments to the external surface of the column abutted by the column plate;

a tensile force is transferred from the steel H-beam to the beam plate, and the tensile force is transferred from the one of the diaphragm segments to another one of the diaphragm segments; and the another one of the diaphragm segments applies a compressive force from the column plate thereof to the column based on the transferred tensile force.

18. The column and beam connection structure according to claim 1, wherein a vertical height of each of the column plates is smaller at a center portion thereof than at an end portion thereof.

19. The column and beam connection structure according to claim 18, wherein the contact pressure applied to each of the external surfaces of the column is greater in vicinities of the corner portions of the column than in vicinities of central portions of the external surfaces of the column.

20. A column and beam connection method for connecting a steel H-beam to a column using an external diaphragm, the column having a uniform rectangular cross-sectional shape along its entire length with four external surfaces meeting at corner portions, the external diaphragm comprising a plurality of diaphragm segments, each of the diaphragm segments comprising a column plate, and one of the diaphragm segments comprising a beam plate, the method comprising:

causing the column plates of the plurality of diaphragm segments to abut the column, such that each of the external surfaces of the column abuts the column plate of only one of the diaphragm segments, and such that joining locations between adjacent ones of the diaphragm segments are located in vicinities of the corner portions of the column installing the beam plate of the one of the diaphragm segments on a flange of the steel H-beam, the beam plate having an end portion at which the column plate of the one of the diaphragm segments is provided; and fastening joining members between the adjacent ones of the diaphragm segments to fix the diaphragm segments such that contact pressure is applied from the column plates to the surfaces of the column;

wherein the diaphragm segments abut on the column via the respective column plates thereof to be fixed to the column, and the column plates are not directly connected to the column by any joining member and are not directly connected to the column by welding.

* * * * *